US008849178B2

(12) United States Patent
Yoshimura et al.

(10) Patent No.: US 8,849,178 B2
(45) Date of Patent: Sep. 30, 2014

(54) SHEET DETECTING APPARATUS AND IMAGE FORMING APPARATUS

(75) Inventors: Akira Yoshimura, Suntou-gun (JP); Kenji Watanabe, Suntou-gun (JP); Minoru Kawanishi, Yokohama (JP); Motohiro Furusawa, Suntou-gun (JP); Yohei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 13/408,129

(22) Filed: Feb. 29, 2012

(65) Prior Publication Data

US 2012/0237280 A1 Sep. 20, 2012

(30) Foreign Application Priority Data

Mar. 16, 2011 (JP) ..... 2011-058349

(51) Int. Cl.
*G03G 15/00* (2006.01)

(52) U.S. Cl.
CPC .. *G03G 15/6558* (2013.01); *G03G 2215/00586* (2013.01); *G03G 2215/00721* (2013.01); *G03G 2215/00616* (2013.01)
USPC ..... 399/388; 271/176; 271/243; 271/245; 271/246; 271/258.01; 271/265.01; 271/264

(58) Field of Classification Search
CPC ..... G03G 15/6558; G03G 2215/00721; G03G 2215/00586
USPC ..... 399/388; 271/243, 245, 246, 258.01, 271/176, 265.01, 264
See application file for complete search history.

(56) References Cited

U.S. PATENT DOCUMENTS

| | | | |
|---|---|---|---|
| 4,855,790 | A | 8/1989 | Suzuki |
| 4,998,121 | A | 3/1991 | Koh et al. |
| 5,157,444 | A | 10/1992 | Mori et al. |
| 5,240,242 | A | 8/1993 | Ando et al. |

(Continued)

FOREIGN PATENT DOCUMENTS

| | | | |
|---|---|---|---|
| CN | 101298303 | A | 11/2008 |
| CN | 101372289 | A | 2/2009 |

(Continued)

OTHER PUBLICATIONS

Chinese Office Action issued in Chinese Application No. 201210064852.8 dated Jul. 1, 2014.

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

A sheet detecting apparatus including: a sheet detecting member having a plurality of abutment surfaces in a peripheral direction thereof, the sheet detecting member being rotated by a conveyed sheet abutting against one of the plurality of abutment surfaces; a detection portion which operates in association with the sheet detecting member; a sensor which generates a signal based on a position of the detection portion; and an urging portion which generates an urging force for positioning the one of the plurality of abutment surfaces of the sheet detecting member in a waiting position in which the leading edge of a sheet conveyed by a conveying portion abuts against the one of the plurality of abutment surfaces, and thereafter the urging portion switching the urging force to an urging force for positioning, in the waiting position, another one of the plurality of abutment surfaces against which a succeeding sheet abuts.

11 Claims, 24 Drawing Sheets

(56) References Cited

U.S. PATENT DOCUMENTS

| | | | | |
|---|---|---|---|---|
| 6,011,948 | A | 1/2000 | Amano et al. | |
| 6,113,093 | A | 9/2000 | Morinaga et al. | |
| 6,385,406 | B1 | 5/2002 | Funamizu et al. | |
| 6,527,267 | B1 | 3/2003 | Kuwata et al. | |
| 6,643,480 | B2 | 11/2003 | Kuwata et al. | |
| 6,832,066 | B2 | 12/2004 | Watanabe et al. | |
| 6,871,848 | B2 | 3/2005 | Matsushima et al. | |
| 7,055,818 | B2 * | 6/2006 | Furusawa | 271/220 |
| 7,077,517 | B2 | 7/2006 | Awai et al. | |
| 7,584,956 | B2 | 9/2009 | Yamagishi | |
| 7,703,757 | B2 | 4/2010 | Watanabe et al. | |
| 8,131,203 | B2 | 3/2012 | Kitan | |
| 8,152,167 | B2 | 4/2012 | Saito et al. | |
| 8,172,227 | B2 | 5/2012 | Furusawa et al. | |
| 8,308,159 | B1 * | 11/2012 | Manor et al. | 271/245 |
| 8,342,519 | B2 * | 1/2013 | Watanabe et al. | 271/243 |
| 8,387,975 | B2 | 3/2013 | Suzuki | |
| 8,439,358 | B2 * | 5/2013 | Watanabe et al. | 271/243 |
| 8,459,639 | B2 * | 6/2013 | Nagao | 271/220 |
| 2008/0202302 | A1 | 8/2008 | Hayashi et al. | |
| 2009/0066009 | A1 | 3/2009 | Matsushima et al. | |
| 2009/0102117 | A1 * | 4/2009 | Yu et al. | 271/226 |
| 2011/0089629 | A1 * | 4/2011 | Furusawa et al. | 271/227 |
| 2012/0080838 | A1 | 4/2012 | Osada et al. | |
| 2012/0093554 | A1 | 4/2012 | Suzuki | |

FOREIGN PATENT DOCUMENTS

| | | | |
|---|---|---|---|
| CN | 101470369 | A | 7/2009 |
| CN | 102556703 | A | 7/2012 |
| CN | 102556710 | A | 7/2012 |
| CN | 102574648 | A | 7/2012 |
| CN | 102574649 | A | 7/2012 |
| JP | 9-183539 | A | 7/1997 |

* cited by examiner

SHEET DETECTING APPARATUS AND IMAGE FORMING APPARATUS

BACKGROUND OF THE INVENTION

1. Field of the Invention

The present invention relates to a sheet detecting apparatus which detects a sheet to be conveyed and an image forming apparatus including the sheet detecting apparatus.

2. Description of the Related Art

In general, a sheet conveying portion of an image forming apparatus includes a sheet detecting apparatus which detects a position of a leading edge of a sheet so as to match a timing for sending the sheet to a transfer position with a timing for sending an image formed by an image forming portion to the transfer position (see Japanese Patent Application Laid-Open No. H09-183539).

FIGS. 23 to 24C illustrate a conventional sheet detecting apparatus. As illustrated in FIGS. 23 and 24A, the conventional sheet detecting apparatus is provided on a downstream side in a sheet conveying direction of conveying roller pairs 518, 519 closest to a transfer position to which an image formed in an image forming portion is to be transferred. The sheet detecting apparatus includes a sensor lever 523 which abuts against a sheet S, a detection sensor 524, a light-shielding portion 525 which shields an optical path from a light-emitting portion to a light-receiving portion of the detection sensor 524 from light, and a stopper portion 526 which positions the sensor lever 523 at a waiting position. The sensor lever 523 is configured so as to be rotatable about a rotary shaft 527 and return to a waiting position due to a pressure force of a return spring 528 after the rotation. The light-shielding portion 525 is formed integrally with the sensor lever 523 and rotates together with the sensor lever 523.

As illustrated in FIG. 24A, when the leading edge of the sheet S comes into contact with the sensor lever 523, the sensor lever 523 rotates in a direction indicated by the arrow in FIG. 24A about the rotary shaft 527 from the waiting position and the light-shielding portion 525 shields the optical path of the detection sensor 524 from light. When the detection sensor 524 detects that the optical path has been shielded from light, the sheet detecting apparatus recognizes that the leading edge of the sheet S has reached the sensor lever 523. After that, the sheet S moves while being in contact with the leading edge of the sensor lever 523. When a trailing edge of the sheet S is separated from the sensor lever 523, the sensor lever 523 is rotated by the return spring 528 in a direction indicated by the arrow in FIG. 24C to return to the waiting position. At this time, the light-shielding portion 525 retreats from the optical path, and the light-receiving portion of the detection sensor 524 receives light from the light-emitting portion again, with the result that the sheet detecting apparatus recognizes that the trailing edge of the sheet S has passed by the sensor lever 523. By the way, in recent years, an image forming apparatus has been requested by users to have further enhanced throughput. In order to enhance throughput in the image forming apparatus, it is necessary to increase a conveying speed of a sheet and to reduce an interval from the trailing edge of a preceding sheet to the leading edge of a succeeding sheet (hereinafter, referred to as "sheet-to-sheet distance"). Therefore, the sheet detecting apparatus needs to return the sensor lever 523 to the waiting position within a short sheet-to-sheet distance after the passage of the preceding sheet S.

On the other hand, the conventional sensor lever 523 is configured in such a manner as to be pressed by the sheet S to rotate when the leading edge of the sheet S having passed by the conveying roller pairs 518, 519 abuts against an abutment portion and to rotate reversely to return to the waiting position when the trailing edge of the sheet S is separated from the abutment portion. Therefore, the distance required as a sheet-to-sheet distance is obtained by summing up a distance D1 from a position in which the trailing edge of a preceding sheet passes by the abutment portion of the sensor lever 523 to the waiting position in which the leading edge of a succeeding sheet abuts against the abutment portion and a distance D2 through which a succeeding sheet is conveyed during that time (see FIG. 24B).

Herein, the distance D2 is a distance ($\Delta T \times V$) obtained by multiplying a time $\Delta T$ during which the sensor lever 523 moves the distance D1 by a sheet conveying speed V. In the case where the sensor lever 523 reciprocates, the distance D1 for the sensor lever 523 to return to the waiting position is generated, and the distance D2 through which the succeeding sheet S is conveyed during the return operation of the sensor lever 523 becomes longer as the sheet conveying speed is higher. Therefore, the conventional sheet detecting apparatus has a problem in that a sheet-to-sheet distance becomes longer when the conveying speed of the sheet S is increased, which prevents the further enhancement of throughput.

SUMMARY OF THE INVENTION

It is therefore an object of the present invention to provide a sheet detecting apparatus which prevents a sheet-to-sheet distance from becoming longer even when a sheet conveying speed is increased, thereby enhancing throughput, and an image forming apparatus including the sheet detecting apparatus.

According to an exemplary embodiment of the present invention, there is provided a sheet detecting apparatus which detects a sheet conveyed by a conveying portion which conveys the sheet, the sheet detecting apparatus including: a sheet detecting member including a plurality of abutment surfaces against which the leading edge of the sheet conveyed by the conveying portion abuts, the plurality of abutment surfaces being formed in a peripheral direction of the sheet detecting member, the sheet detecting member being pressed by the conveyed sheet to rotate; a sensor which generates a signal based on a position of the sheet detecting member; and an urging portion which positions one of the plurality of abutment surfaces of the sheet detecting member in a waiting position in which the leading edge of the sheet conveyed by the conveying portion abuts against the one of the plurality of abutment surfaces. The urging portion includes: a first rotary member connected to a rotary shaft of the sheet detecting member; a second rotary member connected to the first rotary member so as to rotate, when the first rotary member rotates, at a speed ratio of the second rotary member to the first rotary member, wherein the speed ratio is the same number as a number of the plurality of abutment surfaces; and an urging spring which provides the sheet detecting member with an urging force for positioning the one of the plurality of abutment surfaces in the waiting position, the urging spring being connected to the second rotary member in such a manner that, when a rotation of the first rotary member along with a rotation of the sheet detecting member is transmitted to the second rotary member to rotate the second rotary member by a predetermined angle, a state in which the urging spring exerts an urging force for positioning the one of the plurality of abutment surfaces to the waiting position is changed to a state in which the urging spring exerts an urging force for positioning, in the waiting position, another one of the plurality of abutment surfaces against which a succeeding sheet abuts.

According to the present invention, a period of time extending between a time when a preceding sheet passes and a time when an abutment surface of the sheet detecting member is positioned to the waiting position in which the sheet detecting member detects a succeeding sheet can be reduced. Therefore, a sheet can be detected within a short sheet-to-sheet distance even when the sheet conveying speed is increased. Accordingly, it is not necessary to keep the sheet-to-sheet distance large, and the throughput can be enhanced.

Further features of the present invention will become apparent from the following description of exemplary embodiments with reference to the attached drawings.

BRIEF DESCRIPTION OF THE DRAWINGS

FIG. 24B is a view illustrating the sensor lever waiting until the sheet passes by.

DESCRIPTION OF THE EMBODIMENTS

Hereinafter, an image forming apparatus including a sheet conveying portion according to embodiments of the present invention will be described with reference to the drawings. The image forming apparatus according to the embodiments of the present invention is an image forming apparatus including a sheet conveying portion which includes a sheet detecting portion which detects a position of a conveyed sheet, such as a copier, a printer, a facsimile machine, and composite equipment thereof. In the following embodiments, the image forming apparatus will be described, taking an electrophotographic image forming apparatus (hereinafter, referred to as "image forming apparatus") which forms toner images of four colors as an example.

First Embodiment

Figure 1:
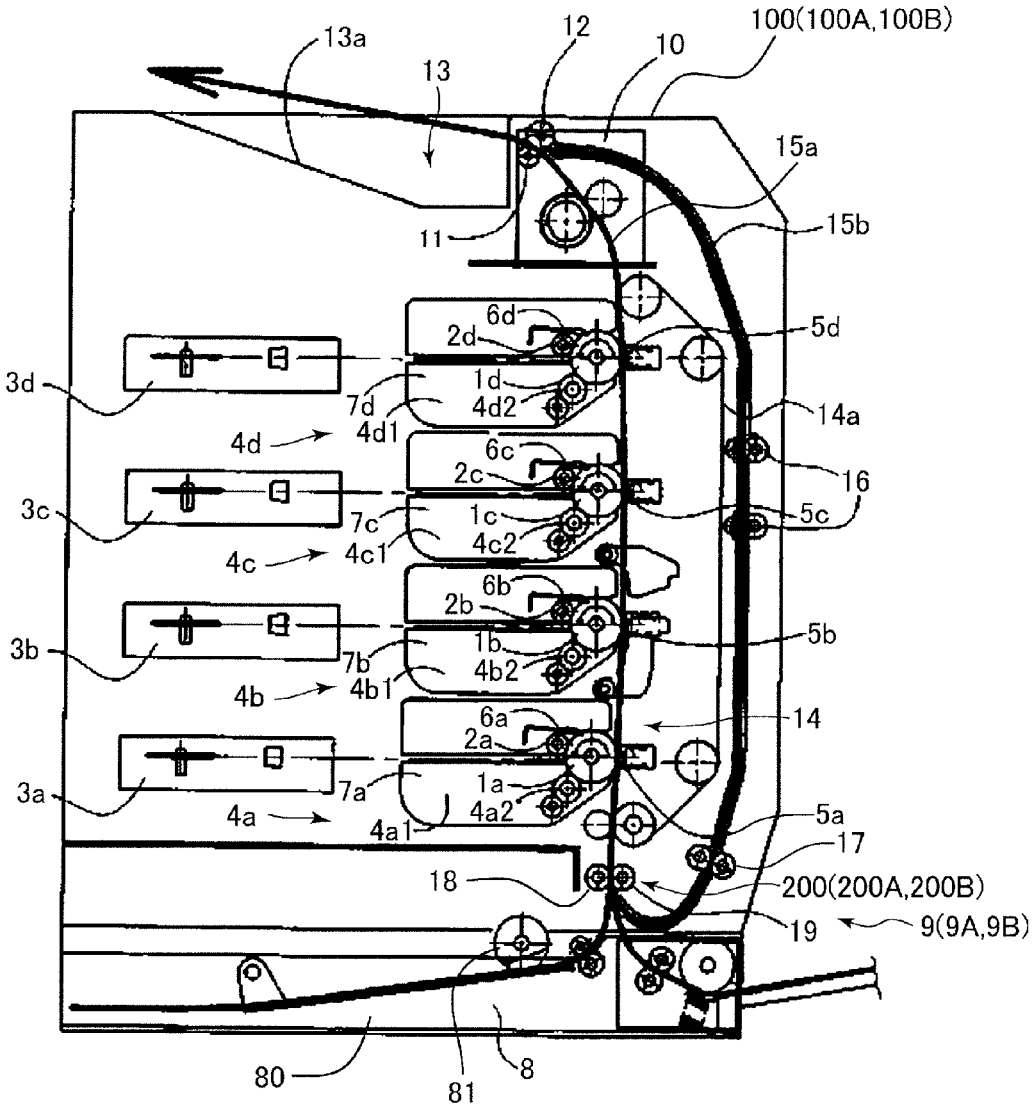
FIG. 1 is a cross-sectional view schematically illustrating an entire structure of an image forming apparatus according to a first embodiment of the present invention.

An image forming apparatus 100 according to a first embodiment of the present invention will be described with reference to FIGS. 1 to 10B. First, an entire structure of the image forming apparatus 100 according to the first embodiment will be described with reference to FIG. 1. FIG. 1 is a cross-sectional view schematically illustrating the entire structure of the image forming apparatus 100 according to the first embodiment of the present invention.

As illustrated in FIG. 1, the image forming apparatus 100 according to the first embodiment includes a sheet feeding portion 8 which feeds sheets S, and a sheet conveying portion 9 which conveys each of the sheets S fed from the sheet feeding portion 8. Further, the image forming apparatus 100 includes an image forming portion 14 which forms an image on the sheet S conveyed from the sheet conveying portion 9, a fixing portion 10 which fixes an unfixed image formed by the image forming portion 14 to the sheet, and a sheet delivery portion 13 which delivers the sheet S with the image fixed thereto.

The sheet feeding portion 8 includes a feed cassette 80 in which the sheets S are stored, a feed roller 81 which feeds the sheets S stored in the feed cassette 80 to the sheet conveying portion 9, and a separation portion (not shown) which separates the sheets S one by one. The sheet feeding portion 8 feeds the sheets S stored in the feed cassette 80 to the sheet conveying portion 9 by the feed roller 81 while separating the sheets S one by one in the separation portion.

The sheet conveying portion 9 is provided downstream of the sheet feeding portion 8 and conveys the sheet S fed from the sheet feeding portion 8 or the sheet S conveyed from a duplex conveying path 15*b* (described later). Further, the sheet conveying portion 9 includes a sheet detecting portion 200 as a sheet detecting apparatus which detects the position of a leading edge of the sheet S. The sheet detecting portion 200 will be described in detail together with the sheet conveying portion 9 described in detail later.

When the sheet detecting portion 200 detects that the sheet S has reached a predetermined position, the image forming portion 14 starts an image formation operation at a predetermined timing. That is, the image forming portion 14 starts forming a toner image (image) at a predetermined timing based on the position of the sheet S and transfers the toner image formed on the sheet S conveyed by the sheet conveying portion 9. The image forming portion 14 includes photosensitive drums 1*a*, 1*b*, 1*c*, and 1*d*, charging portions 2*a*, 2*b*, 2*c*, and 2*d*, exposure portions 3*a*, 3*b*, 3*c*, and 3*d*, developing portions 4*a*, 4*b*, 4*c*, and 4*d*, transfer rollers 5*a*, 5*b*, 5*c*, and 5*d*, and cleaning portions 6*a*, 6*b*, 6*c*, and 6*d*. The image forming portion 14 further includes a transfer belt 14*a*.

The photosensitive drums 1*a* to 1*d* serving as image bearing members are each formed by coating the outer circumferential surface of an aluminum cylinder with an organic photoconductor (OPC) layer. Both ends of each of the photosensitive drums 1*a* to 1*d* are supported by flanges so as to be rotatable. A drive force is transmitted to one end of each of the photosensitive drums 1*a* to 1*d* from a drive motor (not shown), with the result that the photosensitive drums 1*a* to 1*d* rotate counterclockwise in FIG. 1. The charging portions 2*a* to 2*d* respectively allow electroconductive rollers formed into a roller shape to abut against the surfaces of the photosensitive drums 1*a* to 1*d*. A charging bias voltage is applied to the charging portions 2*a* to 2*d* through a power supply (not shown), to thereby uniformly charge the surfaces of the photosensitive drums 1*a* to 1*d*, respectively. The exposure portions 3*a* to 3*d* respectively irradiate the photosensitive drums 1*a* to 1*d* with a laser beam based on image information to form electrostatic latent images on the photosensitive drums 1*a* to 1*d*, respectively.

The developing portions 4*a* to 4*d* respectively include toner containing portions 4*a*1, 4*b*1, 4*c*1, and 4*d*1, and developing roller portions 4*a*2, 4*b*2, 4*c*2, and 4*d*2. The toner containing portions 4*a*1 to 4*d*1 contain toner of respective colors: black, cyan, magenta, and yellow. The developing roller portions 4*a*2 to 4*d*2 are respectively arranged adjacent to the surfaces of photosensitive members. A developing bias voltage is applied to the developing roller portions 4*a*2 to 4*d*2 to thus allow toner of respective colors to adhere to the electrostatic latent images on the photosensitive drums 1*a* to 1*d*, thereby visualizing the electrostatic latent images as toner images.

The transfer rollers 5*a* to 5*d* are arranged inside the transfer belt 14*a* so as to be respectively opposed to the photosensitive drums 1*a* to 1*d* and abut against the transfer belt 14*a*. The transfer rollers 5*a* to 5*d* are each connected to a transfer bias power supply (not shown), and the transfer rollers 5*a* to 5*d* apply positive charges to the sheet S through the transfer belt 14*a*. The electric field enables the negative toner images of the respective colors on the photosensitive drums 1*a* to 1*d* to be transferred successively to the sheet S that is brought into contact with the photosensitive drums 1*a* to 1*d*, with the result that a color image is formed. The cleaning portions 6*a* to 6*d* respectively remove toner remaining on the surfaces of the photosensitive drums 1*a* to 1*d* after the transfer.

In this embodiment, the photosensitive drums 1*a* to 1*d*, the charging portions 2*a* to 2*d*, the developing portions 4*a* to 4*d*, and the cleaning portions 6*a* to 6*d* integrally form process cartridge portions 7*a* to 7*d*, respectively.

The fixing portion 10 heats the sheet S with an unfixed toner image transferred thereto to fix the unfixed toner image. The sheet delivery portion 13 includes a delivery roller pair 11, 12 which rotates forward to convey the sheet S with an image formed thereon and rotates reversely to reverse the sheet S, and a delivery portion 13*a* onto which the sheet S with an image formed thereon is delivered.

Further, the image forming apparatus 100 includes a sheet conveying path 15*a* which conveys the sheet S with the toner image formed thereon by the image forming portion 14, the duplex conveying path 15*b*, an oblique-feed roller pair 16, and a U-turn roller pair 17. The sheet conveying path 15*a* is a conveying path which conveys the sheet S fed from the sheet feeding portion 8 or the sheet S conveyed from the duplex conveying path 15*b*, and the sheet conveying portion 9 and the image forming portion 14 are arranged in the sheet conveying path 15*a*. The duplex conveying path 15*b* is a conveying path which conveys the sheet S reversed by the delivery roller pair 11, 12 for double-sided printing to the sheet conveying path 15*a*. The oblique-feed roller pair 16 is arranged in the duplex conveying path 15*b* and conveys the reversed sheet S. The U-turn roller pair is arranged in the duplex conveying path 15*b* and reconveys the sheet S conveyed in the duplex conveying path 15*b* to the sheet conveying path 15*a*.

The sheet S fed from the sheet feeding portion 8 to the sheet conveying path 15*a* is conveyed to the image forming portion 14 through the sheet detecting portion 200 of the sheet conveying portion 9. When the sheet detecting portion 200 detects the position of a leading edge of the sheet S, the image forming portion 14 starts forming a toner image (image formation operation) at a timing at which the sheet S reaches the transfer rollers 5*a* to 5*d*. When the sheet S has reached the transfer rollers 5*a* to 5*d* after the formation of the toner image is started, the toner images of respective colors on the photosensitive drums 1*a* to 1*d* are transferred to the sheet S successively. Then, the unfixed toner image is fixed to the sheet S in the fixing portion 10 and the sheet S is delivered to the delivery portion 13*a* by the delivery roller pair 11, 12.

Further, in a case of double-sided printing, after the unfixed toner image is fixed onto the sheet S in the fixing portion 10, the delivery roller pair 11, 12 is rotated reversely before the sheet S is delivered to the delivery portion 13*a* by the delivery roller pair 11, 12. Thus, the sheet S is conveyed to the duplex conveying path 15*b*. The sheet S conveyed to the duplex conveying path 15*b* is reconveyed to the image forming portion 14 through the sheet detecting portion 200 by the oblique-feed roller pair 16 and the U-turn roller pair 17 so that the sheet S is subjected to double-sided printing.

Figure 2A:
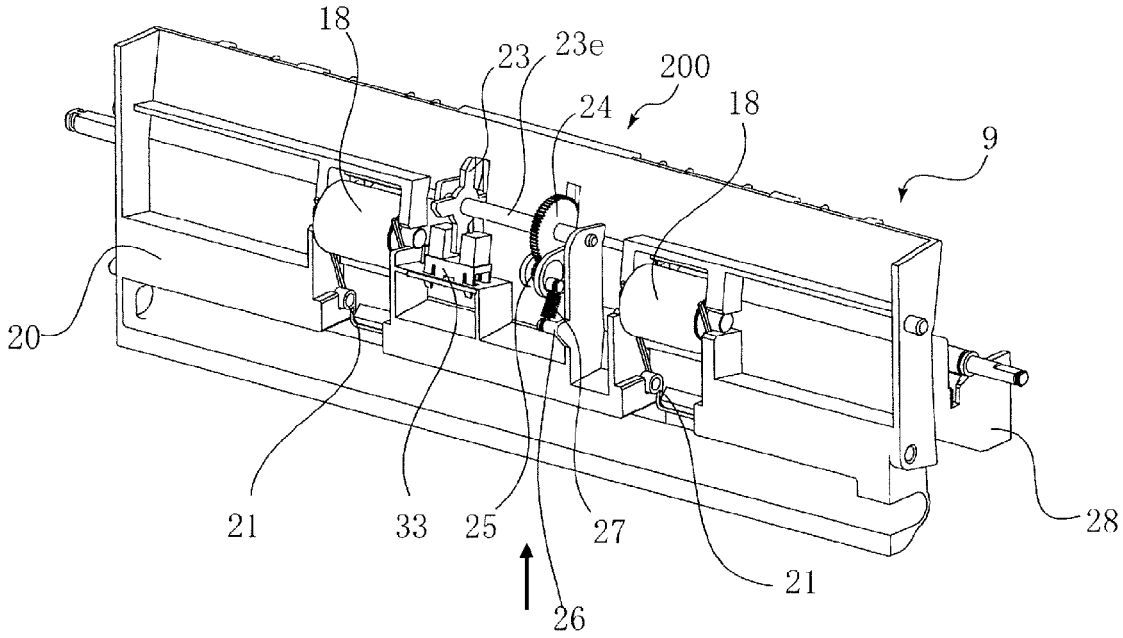
FIG. 2A is a perspective view of a sheet conveying portion of the image forming apparatus according to the first embodiment of the present invention.
Figure 2B:
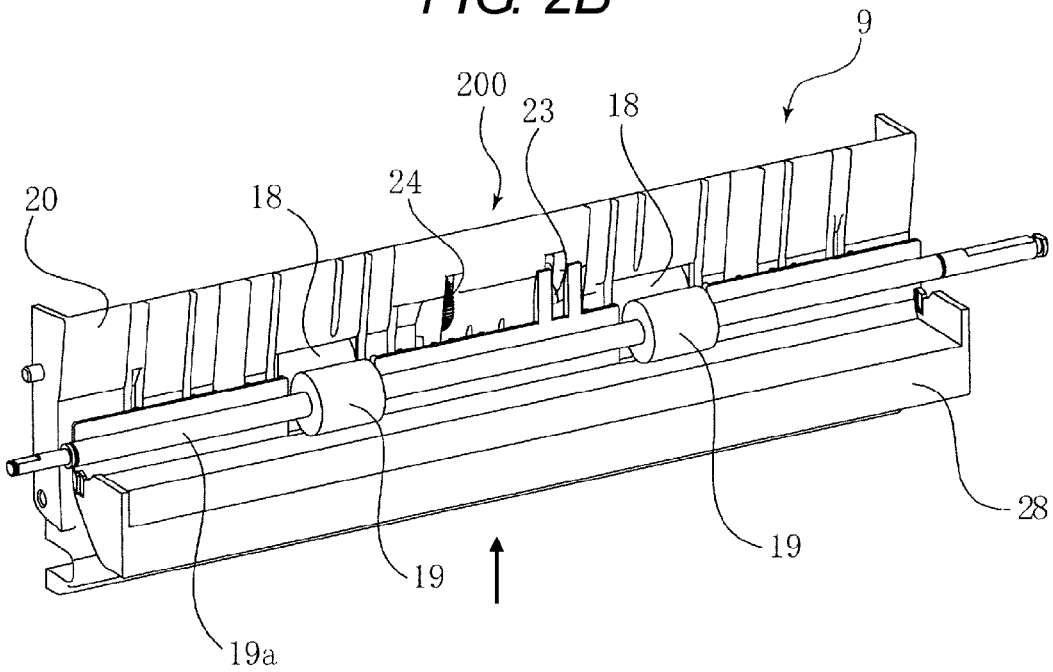
FIG. 2B is a perspective view of the sheet conveying portion illustrated in FIG. 2A, when viewed from an opposite side of FIG. 2A.
Figure 3:
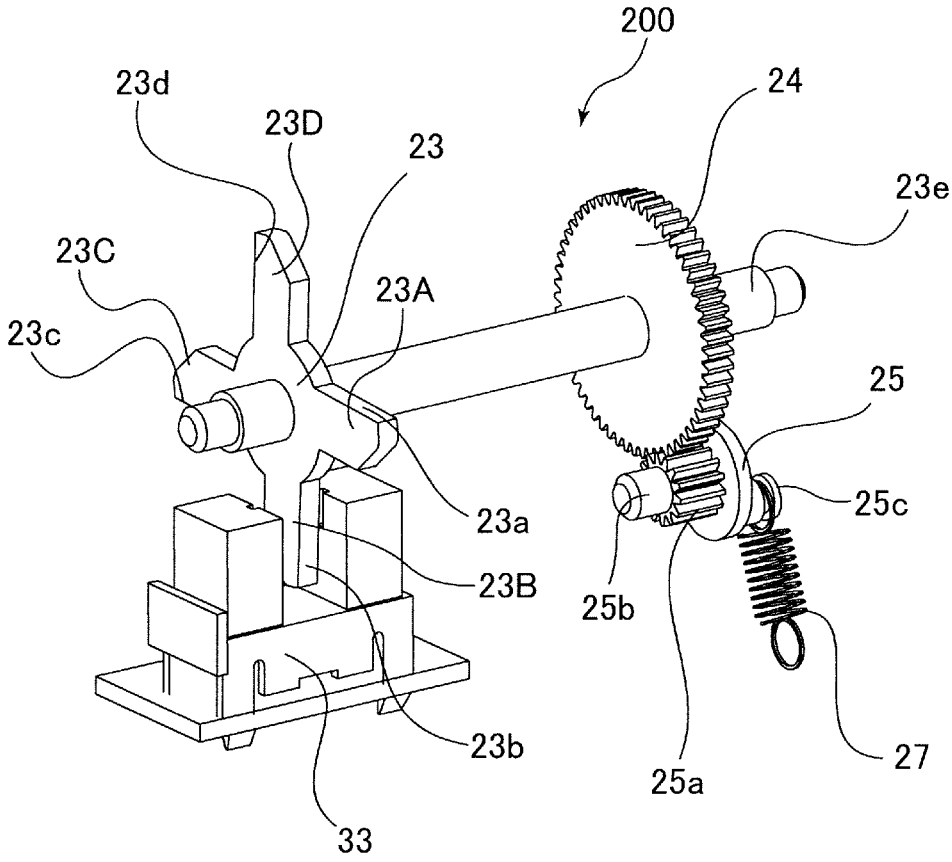
FIG. 3 is an exploded perspective view illustrating a sheet detecting portion according to the first embodiment of the present invention.

Next, the sheet conveying portion 9 will be described specifically with reference to FIGS. 2A to 10B. First, the entire configuration of the sheet conveying portion 9 will be described with reference to FIGS. 2A to 3. FIG. 2A is a perspective view of the sheet conveying portion 9 of the image forming apparatus 100 according to the first embodiment. FIG. 2B is a perspective view of the sheet conveying portion 9 illustrated in FIG. 2A, when viewed from an opposite side of FIG. 2A. FIG. 3 is an exploded perspective view illustrating the sheet detecting portion 200 according to the first embodiment. Arrows illustrated in FIGS. 2A and 2B indicate a conveying direction of the sheet S.

As illustrated in FIGS. 2A and 2B, the sheet conveying portion 9 includes a feed frame 20 and a guide frame 28, conveying roller pairs 18, 19 as a conveying portion which conveys the sheet S conveyed in the sheet conveying path 15*a* to the image forming portion 14, and the sheet detecting portion 200. The feed frame 20 and the guide frame 28 are arranged in the vicinity of an upstream side of the image forming portion 14 in the sheet conveying path 15*a* and support the conveying roller pairs 18, 19 and the sheet detecting portion 200.

The conveying roller pairs 18, 19 include a plurality of conveying rollers 19 and a plurality of conveying rotatable members 18 arranged so as to be respectively opposed to the plurality of conveying rollers 19. The plurality of conveying rollers 19 are fixed to a rotary shaft 19*a* which is rotatably supported in parallel with directions of rotary shafts of the photosensitive drums 1*a* to 1*d* and rotate integrally with the rotary shaft 19*a*. The plurality of conveying rotatable members 18 are rotatably supported by the feed frame 20. Further, the plurality of conveying rotatable members 18 are urged by conveying rotatable member springs 21 mounted to the feed frame 20 with respect to the plurality of conveying rollers 19 and constitute driven rotary members of the conveying rollers 19 which convey the sheet S with the urging force.

The sheet detecting portion 200 is arranged on a downstream side in a sheet conveying direction with respect to the conveying roller pairs 18, 19. As illustrated in FIG. 3, the sheet detecting portion 200 includes a sensor lever 23 as a sheet detecting member, a sensor lever gear 24 as a first rotary member, a sensor lever drive member 25 as a second rotary member, a sensor lever spring 27 as an urging spring, and a detection sensor 33.

The sensor lever 23 is fixed to a sensor lever rotary shaft 23*e* arranged substantially in parallel with the rotary shaft of the conveying roller pairs 18, 19, and the sensor lever rotary shaft 23*e* is rotatably supported by the feed frame 20. Further, light-shielding portions 23A, 23B, 23C, and 23D as four detection portions are formed on the sensor lever 23 at regular intervals in a peripheral direction of the sensor lever 23, and the four light-shielding portions 23A to 23D are formed so as to shield an optical path L (described later) of the detection sensor 33 from light. That is, the four light-shielding portions 23A to 23D and the detection sensor 33 constitute a detector. Further, the four light-shielding portions 23A to 23D are provided with abutment surfaces 23*a*, 23*b*, 23*c*, and 23*d* which abuts against the leading edge of the sheet S at a waiting position, and the abutment surfaces 23*a* to 23*d* are formed so as to face an upstream side in the sheet conveying direction at the waiting position (see FIG. 4A described later).

The sensor lever gear 24 is press-fitted onto the sensor lever rotary shaft 23*e* and rotates about the sensor lever rotary shaft 23*e*. The sensor lever drive member 25 is fixed to a rotary shaft 25*b*, and the rotary shaft 25*b* is arranged in parallel with the sensor lever rotary shaft 23*e* and is rotatably supported by the feed frame 20. Further, the sensor lever drive member 25 includes a gear portion 25*a* which is meshed with the sensor lever gear 24 and a connecting portion 25*c* which is provided at a position eccentric from the rotation center. The number of teeth of the gear portion 25*a* is set so that a gear ratio of the gear portion 25*a* to the sensor lever gear 24 becomes 4:1. A ¼ turn of the sensor lever gear 24 causes one turn of the sensor lever drive member 25. That is, the gear ratio (speed ratio) between the sensor lever gear 24 and the gear portion 25*a* of the sensor lever drive member 25 is set to be the same number as the number of the abutment surfaces 23*a* to 23*d* of the sensor lever 23. In this embodiment the speed ratio of the gear portion 25*a* to the sensor lever gear 24 when the sensor lever gear 24 rotates is 4 as the same number of the abutment surfaces 23*a* to 23*d* of the sensor lever 23. Thus, when the sensor lever drive member 25 makes one turn (rotation angle is large), the abutment surfaces 23*a* to 23*d* are switched successively.

One end of the sensor lever spring 27 is connected to the connecting portion 25*c*, and the other end thereof is positionally-fixed to a spring stretching portion 26 formed on the feed frame. That is, the sensor lever spring 27 and the sensor lever drive member 25 constitute a crank mechanism which causes the sensor lever spring 27 to expand and contract to rotate the sensor lever drive member 25. In this embodiment, the sensor lever spring 27 is set so that, when the sensor lever 23 is at the waiting position, the sensor lever spring 27 is in a balanced state, that is, the spring length of the sensor lever spring 27 becomes shortest.

The detection sensor 33 is an optical sensor (for example, a photo interrupter) in which the optical path L is formed of a light-emitting element and a light-receiving element and is mounted to the feed frame 20. The detection sensor 33 is arranged in a circuit path of the light-shielding portions 23A to 23D of the sensor lever 23. When the sensor lever 23 rotates and the light-shielding portions 23A to 23D shield the optical path L from light, the detection sensor 33 detects that the sheet S has been conveyed to a predetermined position. The detection sensor 33 is a sensor which generates a signal in accordance with the positions of the light-shielding portions 23A to 23D that rotate along with the conveyance of the sheet S, and the arrival of the sheet S is detected based on the signal from the detection sensor 33.

Figure 4B:
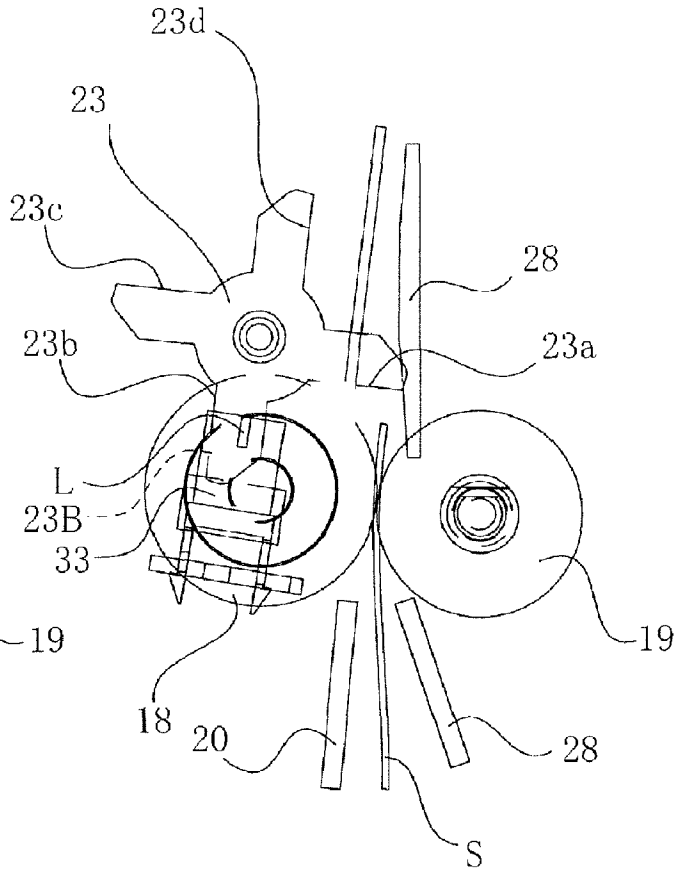
FIG. 4B is a view illustrating a sensor lever and a detection sensor of FIG. 4A.
Figure 4A:
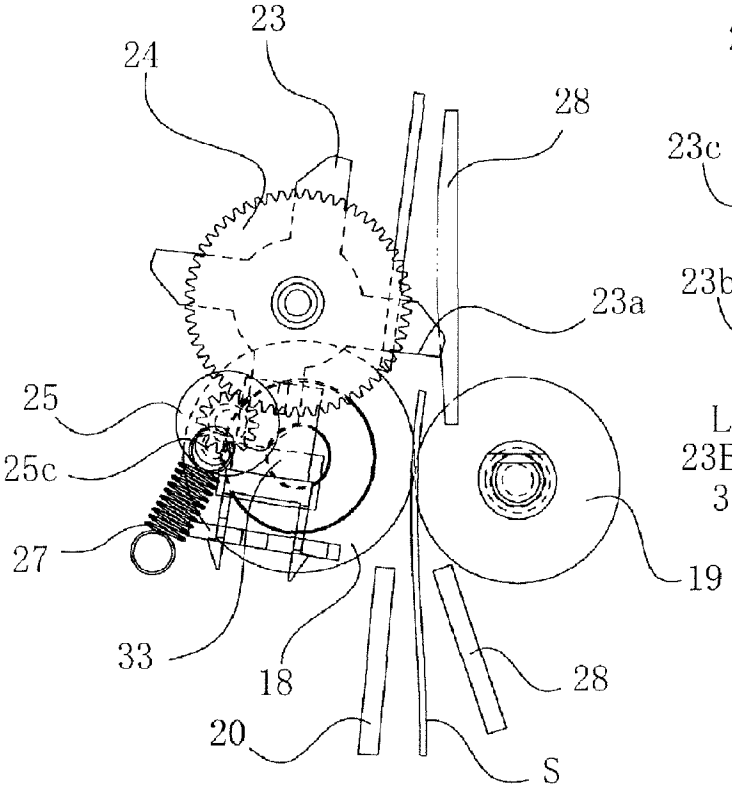
FIG. 4A is a view illustrating a state in which a sheet is conveyed to the sheet detecting portion according to the first embodiment of the present invention.
Figure 5B:
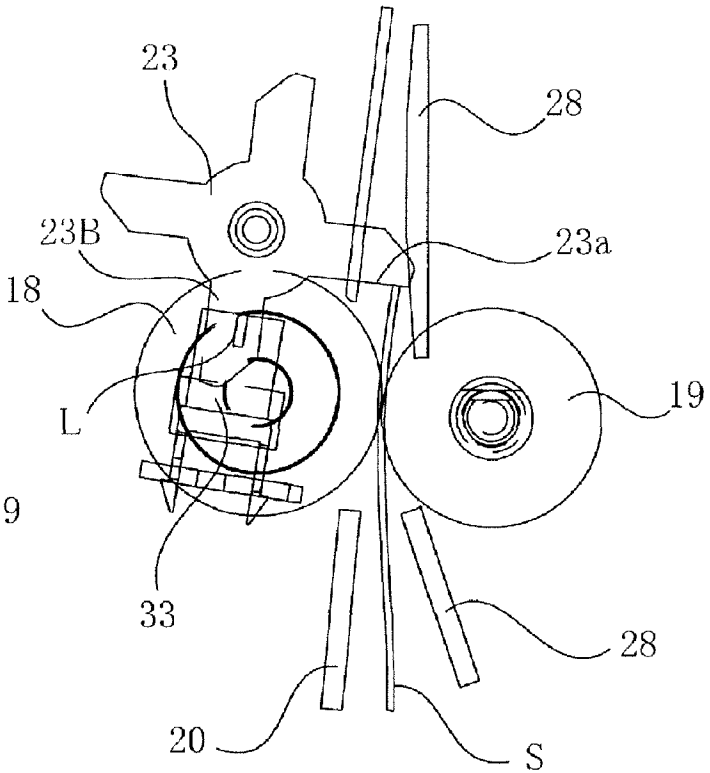
FIG. 5B is a view illustrating the sensor lever and the detection sensor of FIG. 5A.
Figure 5A:
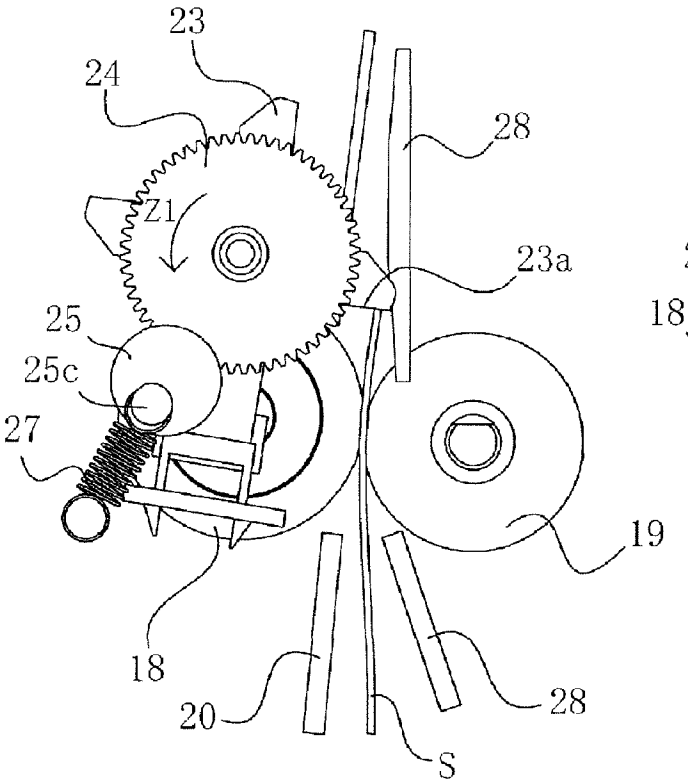
FIG. 5A is a view illustrating a state in which the leading edge of a sheet abuts against the sensor lever of the sheet detecting portion illustrated in FIG. 4A.
Figure 6B:
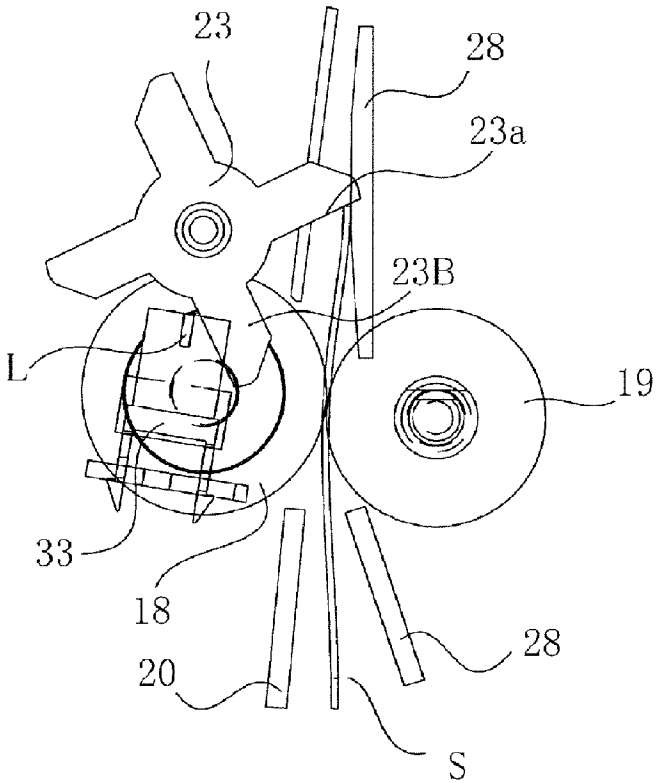
FIG. 6B is a view illustrating the sensor lever and the detection sensor of FIG. 6A.
Figure 6A:
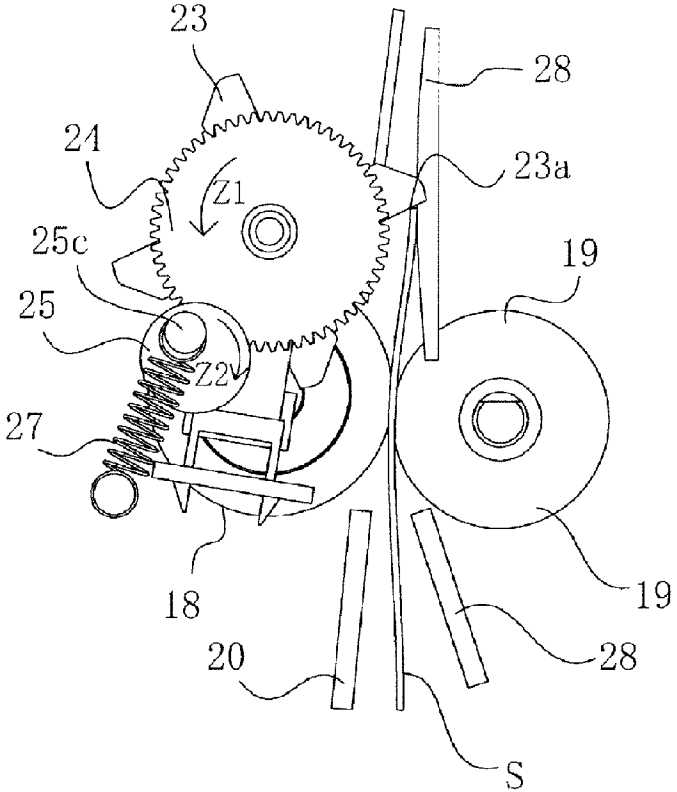
FIG. 6A is a view illustrating a state in which the leading edge of a sheet abuts against the sensor lever of the sheet detecting portion illustrated in FIG. 5A to rotate the sensor lever.

Next, the operation of the sheet conveying portion 9 will be described with reference to FIGS. 1 and 4A to 10B. FIG. 4A is a view illustrating a state in which the sheet S is conveyed to the sheet detecting portion 200 according to the first embodiment. FIG. 4B is a view illustrating the sensor lever 23 and the detection sensor 33 of FIG. 4A. FIG. 5A is a view illustrating a state in which the leading edge of the sheet S abuts against the sensor lever 23 of the sheet detecting portion 200 of FIG. 4A. FIG. 5B is a view illustrating the sensor lever 23 and the detection sensor 33 of FIG. 5A. FIG. 6A is a view illustrating a state in which the leading edge of the sheet S abuts against the sensor lever 23 of the sheet detecting portion 200 illustrated in FIG. 5A to rotate the sensor lever 23. FIG. 6B is a view illustrating the sensor lever 23 and the detection sensor 33 of FIG. 6A.

Figure 7B:
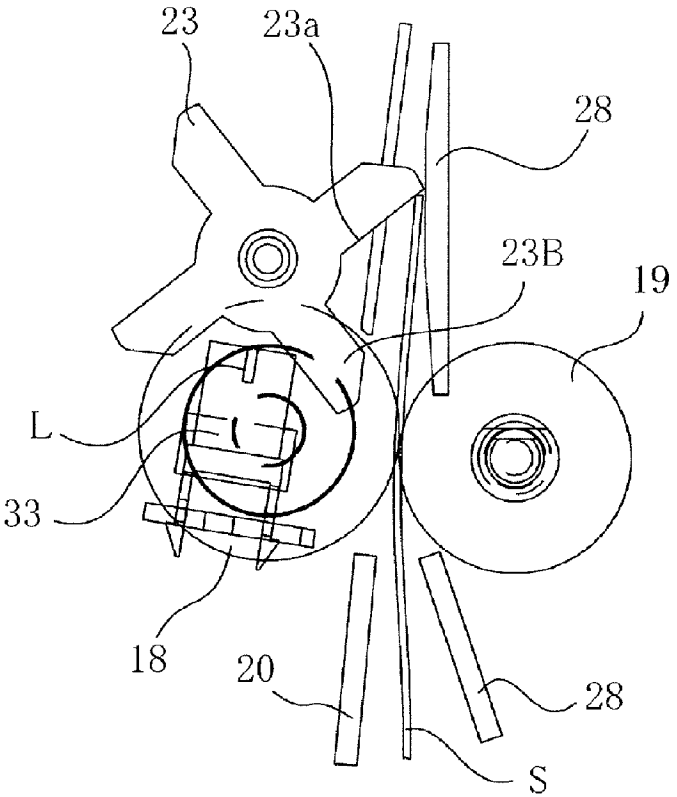
FIG. 7B is a view illustrating the sensor lever and the detection sensor of FIG. 7A.
Figure 7A:
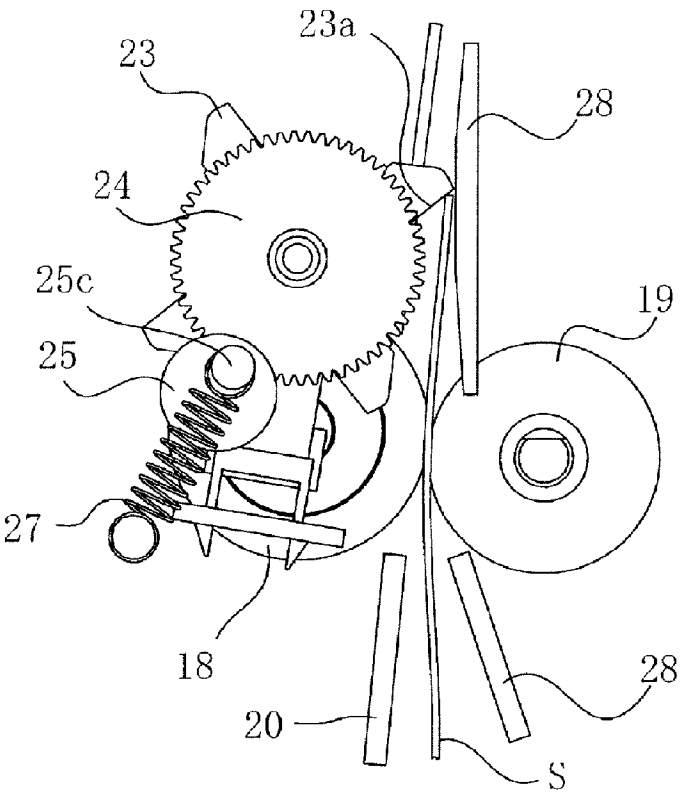
FIG. 7A is a view illustrating a state in which the sensor lever of the sheet detecting portion illustrated in FIG. 6A rotates to expand a shutter spring to its maximum length.
Figure 8B:
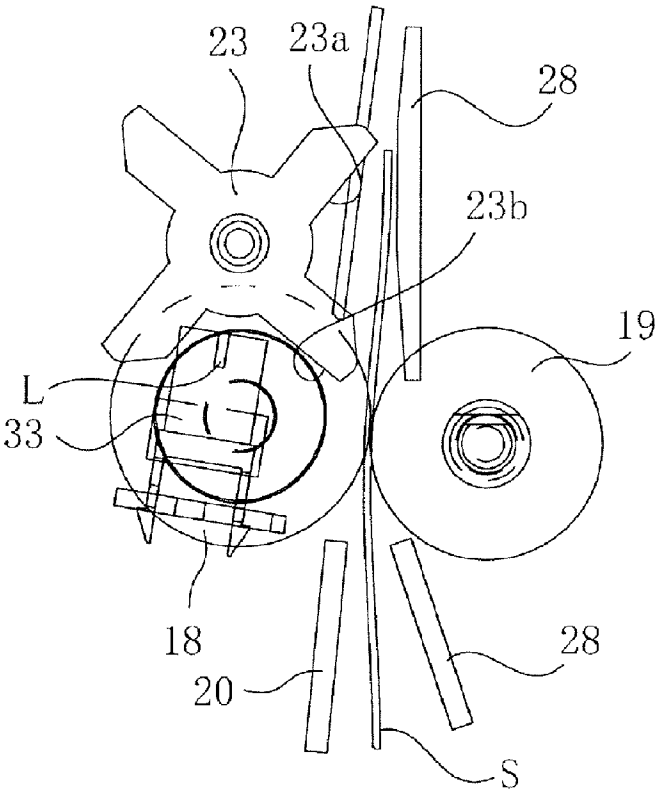
FIG. 8B is a view illustrating the sensor lever and the detection sensor of FIG. 8A.
Figure 8A:
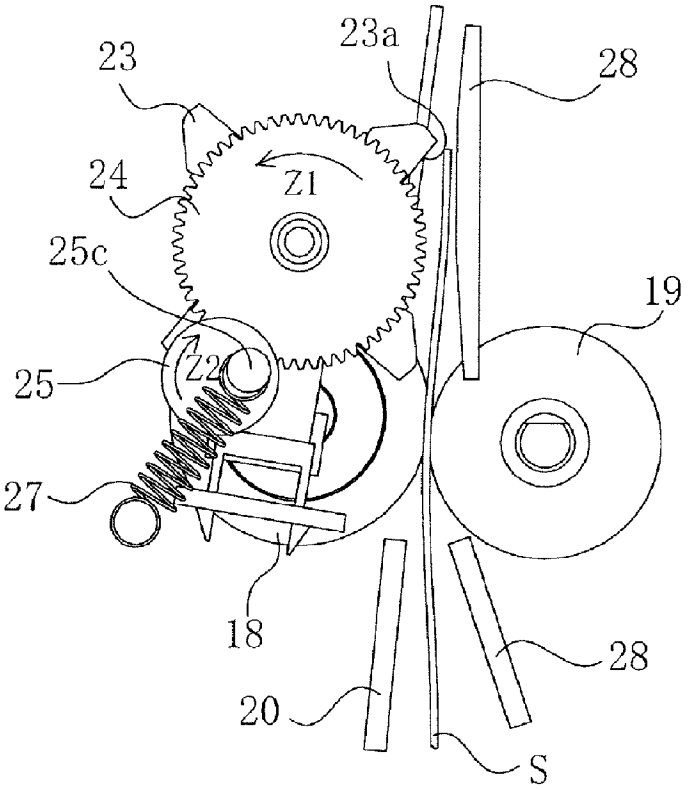
FIG. 8A is a view illustrating a state in which the sensor lever of the sheet detecting portion illustrated in FIG. 7A rotates due to the rotation force of the shutter spring.
Figure 9B:
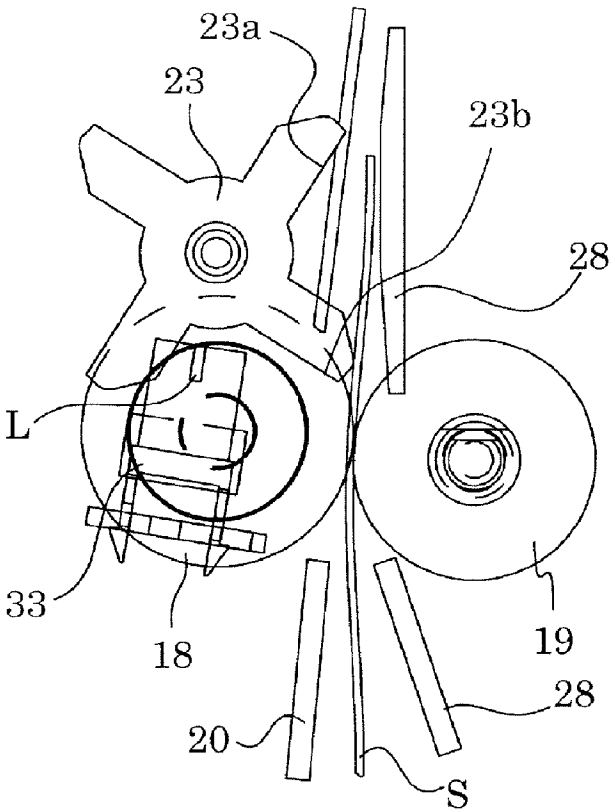
FIG. 9B is a view illustrating the sensor lever and the detection sensor of FIG. 9A.
Figure 9A:
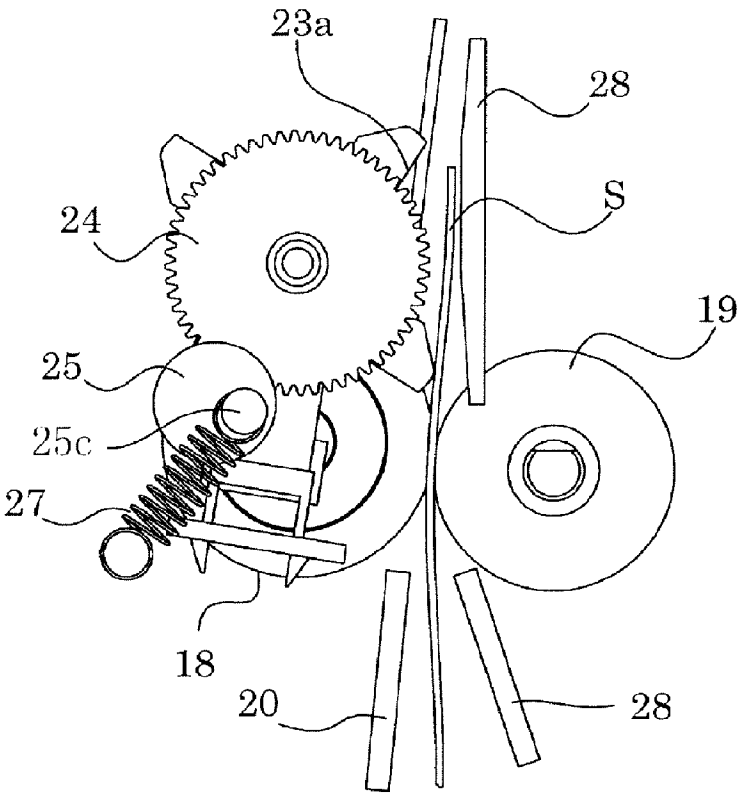
FIG. 9A is a view illustrating a state in which the sensor lever of the sheet detecting portion illustrated in FIG. 8A rotates to retreat an abutment surface.
Figure 10B:
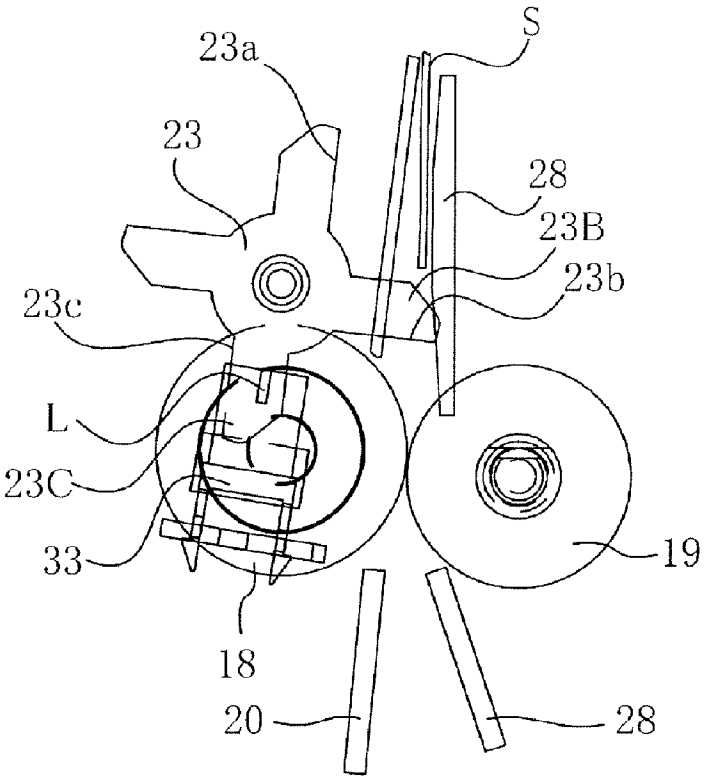
FIG. 10B is a view illustrating the sensor lever and the detection sensor of FIG. 10A.
Figure 10A:
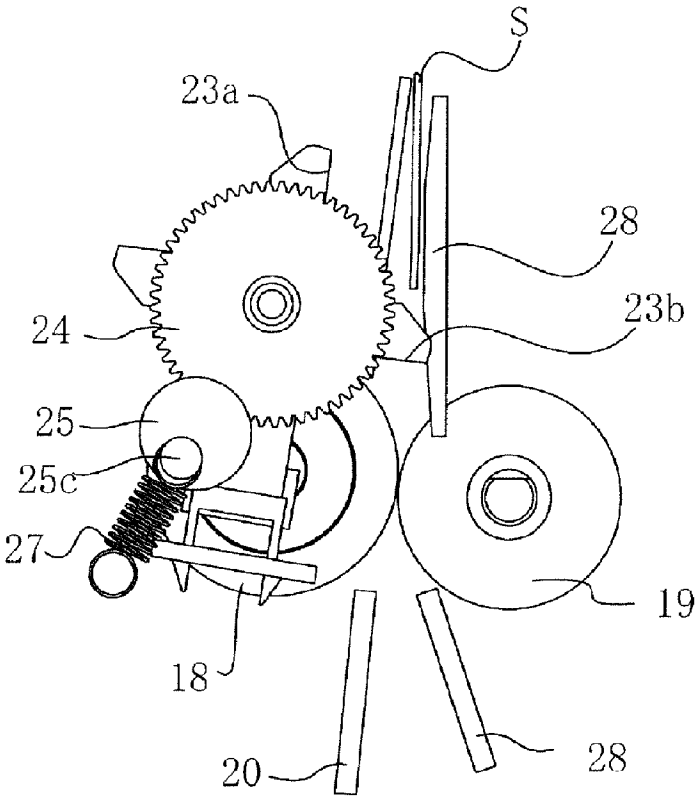
FIG. 10A is a view illustrating a state in which a sheet passes by the sheet detecting portion illustrated in FIG. 9A and a succeeding abutment surface is positioned in a waiting position.

FIG. 7A is a view illustrating a state in which the sensor lever 23 of the sheet detecting portion 200 illustrated in FIG. 6A rotates to expand the sensor lever spring 27 to its maximum length. FIG. 7B is a view illustrating the sensor lever 23 and the detection sensor 33 of FIG. 7A. FIG. 8A is a view illustrating a state in which the sensor lever 23 of the sheet detecting portion 200 illustrated in FIG. 7A rotates due to the rotation force of the sensor lever spring 27. FIG. 8B is a view illustrating the sensor lever 23 and the detection sensor 33 of FIG. 8A. FIG. 9A is a view illustrating a state in which the sensor lever 23 of the sheet detecting portion 200 illustrated in FIG. 8A rotates to retreat the abutment surface 23*a*. FIG. 9B is a view illustrating the sensor lever 23 and the detection sensor 33 of FIG. 9A. FIG. 10A is a view illustrating a state in which the sheet S passes by the sheet detecting portion 200 illustrated in FIG. 9A and the succeeding abutment surface 23*b* is positioned in the waiting position. FIG. 10B is a view illustrating the sensor lever 23 and the detection sensor 33 of FIG. 10A.

As illustrated in FIG. 1, the sheet S conveyed in the sheet conveying path 15*a* is conveyed to the image forming portion 14 through the sheet detecting portion 200 by the conveying roller pairs 18, 19, and the image forming portion 14 starts an image formation operation based on the position of a leading edge of the sheet S detected by the sheet detecting portion 200. Hereinafter, the operation of the sheet conveying portion 9 will be described specifically.

As illustrated in FIG. 4A, when the leading edge of the sheet S does not abut against the abutment surface 23*a* of the sensor lever 23, the abutment surface 23*a* is held in a state of waiting at the waiting position with an urging force (retention force) of the sensor lever spring 27. At this time, the sensor lever spring 27 is shortened to its minimum length, and the connecting portion 25*c* connected to the sensor lever spring 27 is positioned at a bottom dead center in the sensor lever spring 27. Further, the optical path L of the detection sensor 33 at this time is shielded from light by the light-shielding portion 23B, as illustrated in FIG. 4B.

Next, as illustrated in FIG. 5A, when the leading edge of the sheet S conveyed by the conveying roller pairs 18, 19 abuts against the abutment surface 23*a* of the sensor lever 23, the sheet S presses the abutment surface 23*a* against the urging force of the sensor lever spring 27 with a conveying force of the conveying roller pairs 18, 19. When the sheet S presses the abutment surface 23*a*, the sensor lever 23 starts rotating in a direction indicated by the arrow Z1 in FIG. 5A. Thus, as illustrated in FIG. 5B, the light-shielding portion 23B which has shielded the optical path L of the detection sensor 33 from light also starts rotating. In this state (at a time of start of rotation), the optical path L is still shielded from light by the light-shielding portion 23B.

Further, the sheet S at this time is conveyed against the retention force of the sensor lever drive member 25 urged by the sensor lever spring 27. Then, the leading edge of the sheet S is guided by a sheet-passage guide which is formed of the feed frame 20 and the guide frame 28 and arranged downstream of the conveying roller pairs 18, 19 in the sheet conveying direction. The sheet-passage guide prevents the leading edge of the sheet S from coming off from the abutment surface 23*a* and the leading edge of the sheet S rotates the sensor lever 23 reliably.

As illustrated in FIG. 6A, when the sensor lever is pressed by the sheet S to rotate in the direction indicated by the arrow Z1, the sensor lever gear 24 fixed to the sensor lever rotary shaft 23*e* rotates in the direction indicated by the arrow Z1. When the sensor lever gear 24 rotates in the direction indicated by the arrow Z1, the sensor lever gear 24 and the gear portion 25*a* are meshed with each other, and the sensor lever drive member 25 rotates in a direction indicated by the arrow Z2 in FIG. 6A. At this time, as illustrated in FIG. 6B, the light-shielding portion 23B stops shielding the optical path L of the detection sensor 33 from light, and the detection sensor 33 detects that the leading edge of the sheet S has reached a desired position to issue a predetermined signal. Then, the image forming portion 14 starts an image formation operation based on the signal.

As illustrated in FIGS. 7A and 7B, when the leading edge of the sheet S presses the abutment surface 23*a* to rotate the sensor lever 23, and the sensor lever drive member 25 rotates at an increased speed at a speed ratio of the same number as the number of abutment surfaces, the connecting portion 25*c* is positioned at a top dead center of the sensor lever spring 27. That is, the sensor lever drive member 25 turns by 180° (predetermined angle rotation) and the sensor lever spring 27 expands to its maximum length (the maximum length state). Then, as illustrated in FIGS. 8A and 8B, when the sensor lever 23 further rotates in the Z1 direction, and the sensor lever drive member 25 rotates in the Z2 direction, the connecting portion 25*c* passes over the top dead center of the sensor lever spring 27. When the connecting portion 25*c* passes over the top dead center, the sensor lever 23 is provided with a rotation force for rotating the sensor lever 23 in the Z1 direction from the sensor lever spring 27, instead of from the sheet S. The rotation force allows the succeeding abutment surface 23*b* to be positioned in the waiting position and holds the succeeding abutment surface 23*b* in the waiting position in the same way as in the abutment surface 23*a*.

As illustrated in FIGS. 9A and 9B, when the sensor lever 23 is provided with the rotation force for rotating the sensor lever 23 in the Z1 direction from the sensor lever spring 27, the sensor lever 23 rotates in the Z1 direction, and the sheet S is being conveyed by the conveying roller pairs 18, 19. Therefore, the sensor lever cannot rotate any more, and the succeeding abutment surface 23*b* on the upstream side of the abutment surface 23*a* cannot be positioned in the waiting position (cannot protrude to the sheet conveying path 15*a*). Thus, the succeeding abutment surface 23*b* remains waiting until the sheet S passes by, with the light-shielding portion 23B abutting against the surface of the sheet S.

Then, as illustrated in FIG. 10A, when the trailing edge of the sheet S passes through the nip of the conveying roller pairs 18, 19, the sensor lever 23 rotates in the Z1 direction due to the rotation force of the sensor lever spring 27, and the succeeding abutment surface 23*b* protrudes to the sheet conveying path 15*a* to be positioned in the waiting position. At this time, as illustrated in FIG. 10B, the light-shielding portion 23C, on which the abutment surface 23*c* succeeding to the abutment surface 23*b* is formed, shields the optical path L of the detection sensor 33 from light, and the detection sensor 33 is enabled to detect the position of a leading edge of the sheet S.

As illustrated in FIGS. 4A to 10B, through the repetition of the above-mentioned operation, the sensor lever 23 and the sensor lever gear 24 fixed to the sensor lever rotary shaft 23*e* rotate, and the sensor lever drive member 25 rotates at an increased speed at a speed ratio of the same number as the number of abutment surfaces. Thus, the sensor lever drive member 25 makes one turn in the middle of the rotation of the sensor lever 23, and the abutment surfaces 23*a* to 23*d* are switched successively in the order of 23*a*, 23*b*, 23*c*, 23*d*, and 23*a*.

The image forming apparatus 100 according to the first embodiment having the above-mentioned configuration exhibits the following effects. The sheet detecting portion 200 of the image forming apparatus 100 according to the first embodiment is configured in such a manner that the plurality of abutment surfaces 23*a* to 23*d* are provided, and the sensor lever 23 is rotated in one direction to position the plurality of abutment surfaces 23*a* to 23*d* successively in the waiting position. Therefore, when the sensor lever 23 moves to the waiting position for detecting the leading edge of a succeeding sheet, the sensor lever 23 can be positioned in the waiting position for detecting the leading edge of the succeeding sheet S almost at the same time as the time when the trailing edge of the preceding sheet S is separated from the sensor lever 23. Further, it is not necessary to operate in a direction opposite to the conveying direction. Thus, the sensor lever 23 can be rotated in the same direction as the sheet conveying direction at a speed almost equal to the sheet conveying speed to be returned to the waiting position. As a result, even in the case where the sheet conveying speed is increased, the sheet S can be detected reliably even when a plurality of sheets are fed with establishing a short sheet-to-sheet distance between the sheets.

Further, in the conventional sensor lever 23, there is only one abutment surface against which the leading edge of the sheet S abuts, and there is a risk that the abutment surface may be abraded depending upon the sheet-passage number of the sheet S. However, in this embodiment, the abrasion of the abutment surface can be reduced by providing the plurality of abutment surfaces 23*a* to 23*d* at the sensor lever 23. In this embodiment, the abutment surfaces of the sensor lever 23 are provided at four places, but the similar effect is obtained even with the configuration in which the abutment surfaces are provided at one to three places depending upon the endurable number of supplied sheets.

Second Embodiment

Next, an image forming apparatus 100A according to a second embodiment of the present invention will be described with reference to FIGS. 11A to 16B together with FIG. 1. The image forming apparatus 100A according to the second embodiment is different from the image forming apparatus 100 of the first embodiment in that a detecting member 231 which operates in association with the sensor lever 23 is provided in a sheet detecting portion 200A of a sheet conveying portion 9A. Therefore, in the second embodiment, the point different from the first embodiment, that is, the detecting member 231 will be mainly described. Note that, in the second embodiment, the same components as those of the image forming apparatus 100 according to the first embodiment are denoted by the same reference symbols, and the descriptions thereof are omitted. In the second embodiment, the same components as those of the first embodiment produce the same effects as those of the first embodiment.

Figure 11A:
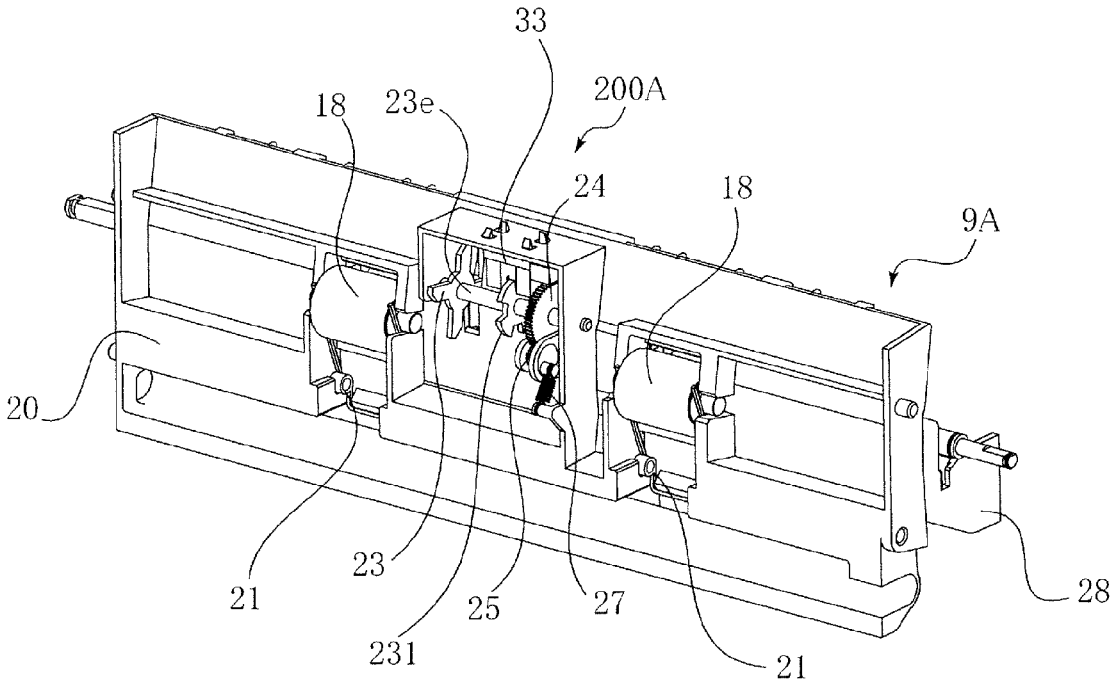
FIG. 11A is a perspective view of a sheet conveying portion of an image forming apparatus according to a second embodiment of the present invention.
Figure 11B:
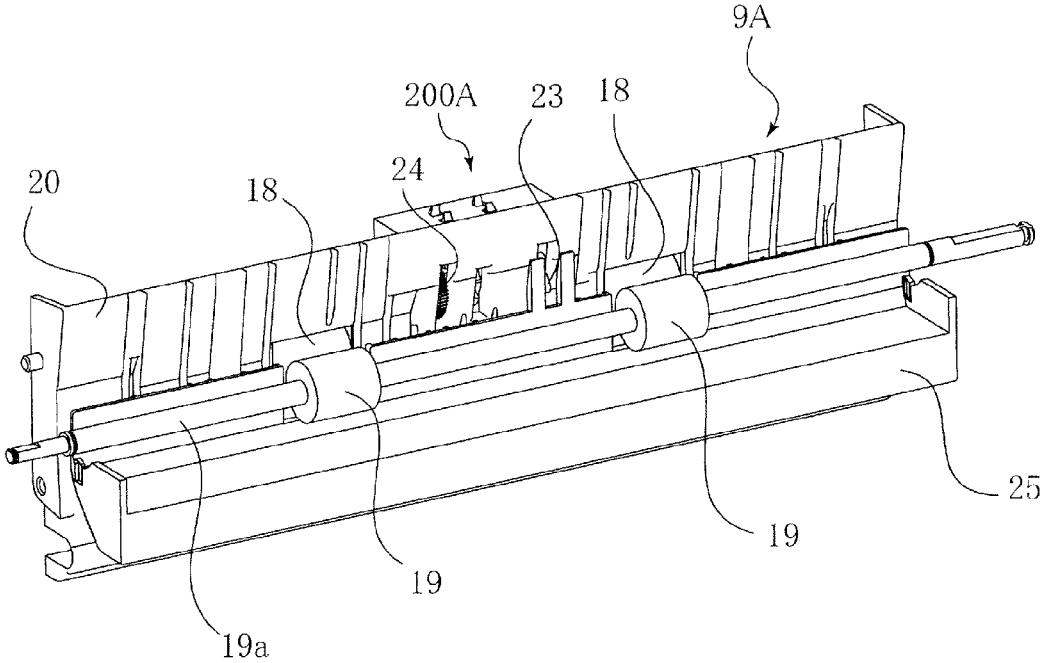
FIG. 11B is a perspective view of the sheet conveying portion illustrated in FIG. 11A, when viewed from an opposite side of FIG. 11A.
Figure 12:
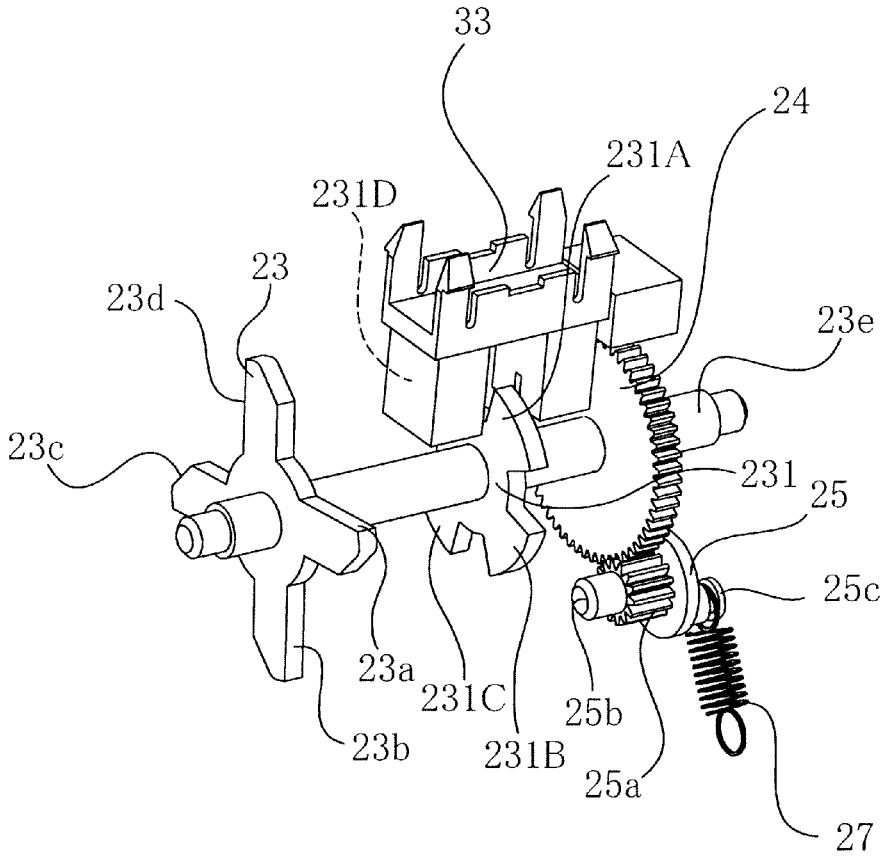
FIG. 12 is a perspective view illustrating a sheet detecting portion according to the second embodiment of the present invention.

First, an entire structure of the image forming apparatus 100A according to the second embodiment will be described with reference to FIGS. 11A to 12 together with FIG. 1. FIG. 11A is a perspective view of the sheet conveying portion 9A of the image forming apparatus 100A according to the second embodiment. FIG. 11B is a perspective view of the sheet conveying portion 9A illustrated in FIG. 11A, when viewed from an opposite side of FIG. 11A. FIG. 12 is a perspective view illustrating the sheet detecting portion 200A according to the second embodiment.

As illustrated in FIG. 1, the image forming apparatus 100A includes the sheet feeding portion 8, the sheet conveying portion 9A, the image forming portion 14, the fixing portion 10, and the sheet delivery portion 13. As illustrated in FIGS. 11A and 11B, the sheet conveying portion 9A includes the feed frame 20 and the guide frame 28, the conveying roller pairs 18, 19, and the sheet detecting portion 200A. As illustrated in FIG. 12, the sheet detecting portion 200A includes the sensor lever 23, the sensor lever gear 24, the sensor lever drive member 25, the sensor lever spring 27, the detection sensor 33, and the detecting member 231.

The detecting member 231 is fixed to the sensor lever rotary shaft 23*e* and rotates integrally with the sensor lever 23 and the sensor lever gear 24. Further, the detecting member 231 is provided in a peripheral direction of the detecting member 231 with four light-shielding portions 231A, 231B, 231C, and 231D at regular intervals, which are equal in number to the abutment surfaces 23*a* to 23*d*. The four light-shielding portions 231A to 231D are formed so as to shield the optical path L of the detection sensor 33 from light. The four light-shielding portions 231A to 231D and the detection sensor 33 constitute a detector.

Figure 13B:
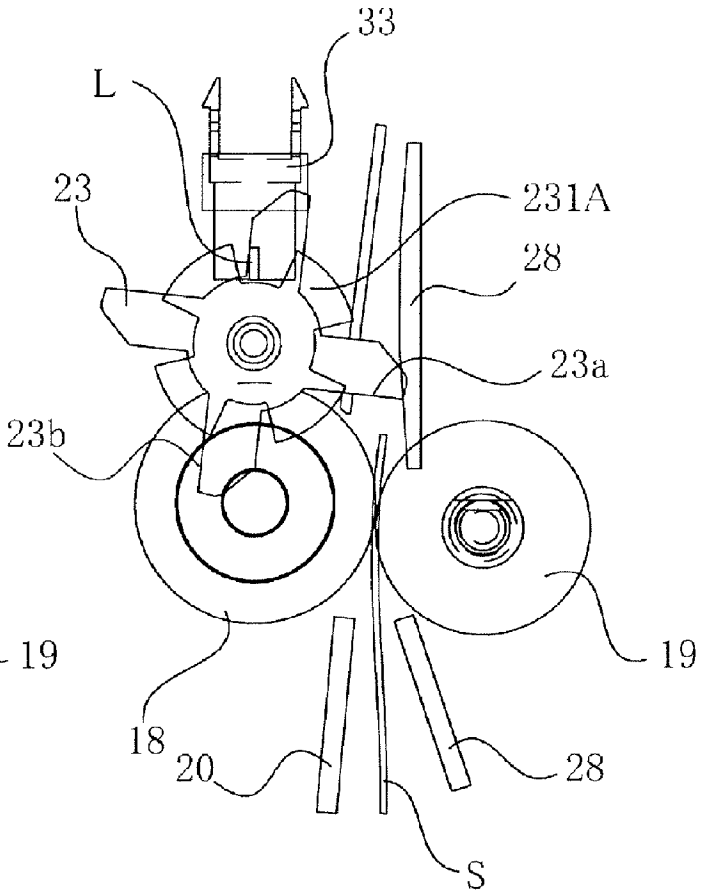
FIG. 13B is a view illustrating a sensor lever, a detection sensor, and a detecting member of FIG. 13A.
Figure 13A:
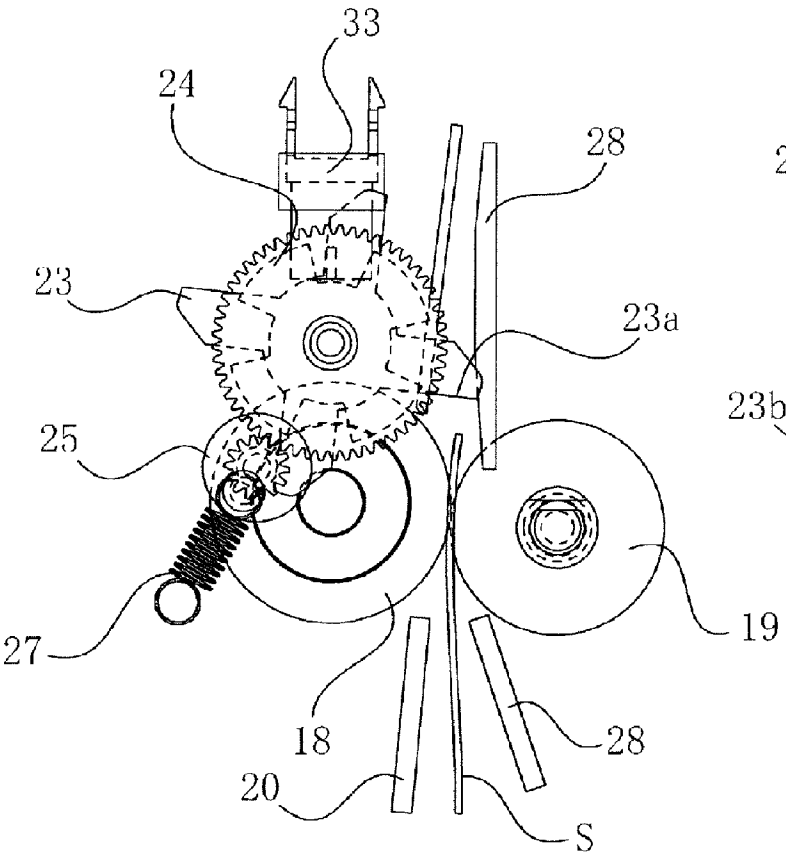
FIG. 13A is a view illustrating a state in which a sheet is conveyed to the sheet detecting portion according to the second embodiment of the present invention.
Figure 14B:
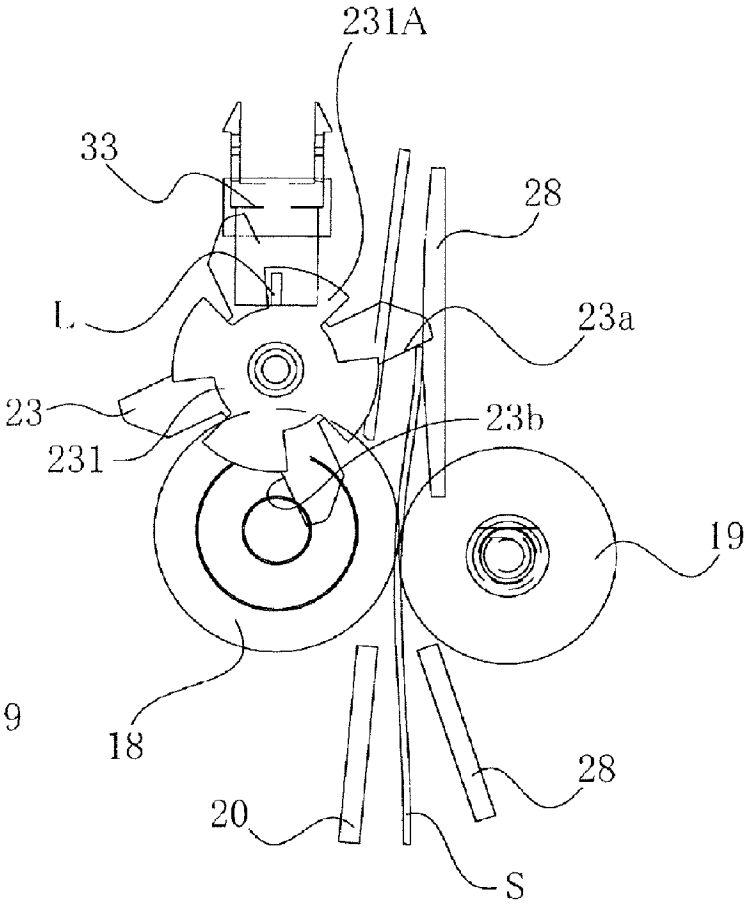
FIG. 14B is a view illustrating the sensor lever, the detection sensor, and the detecting member of FIG. 14A.
Figure 14A:
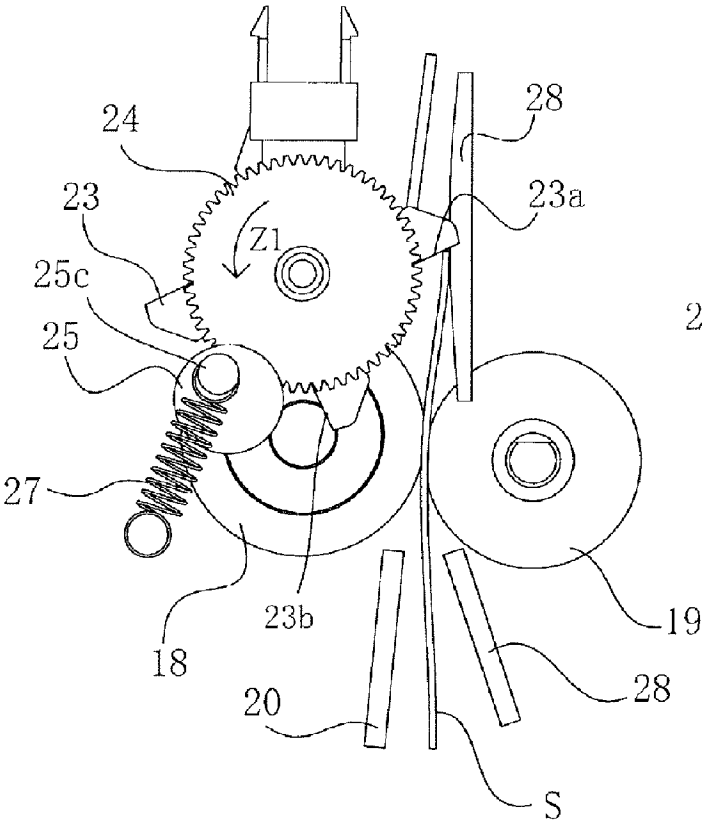
FIG. 14A is a view illustrating a state in which the leading edge of a sheet abuts against an abutment surface of the sensor lever of the sheet detecting portion illustrated in FIG. 13A to rotate the sensor lever.
Figure 15B:
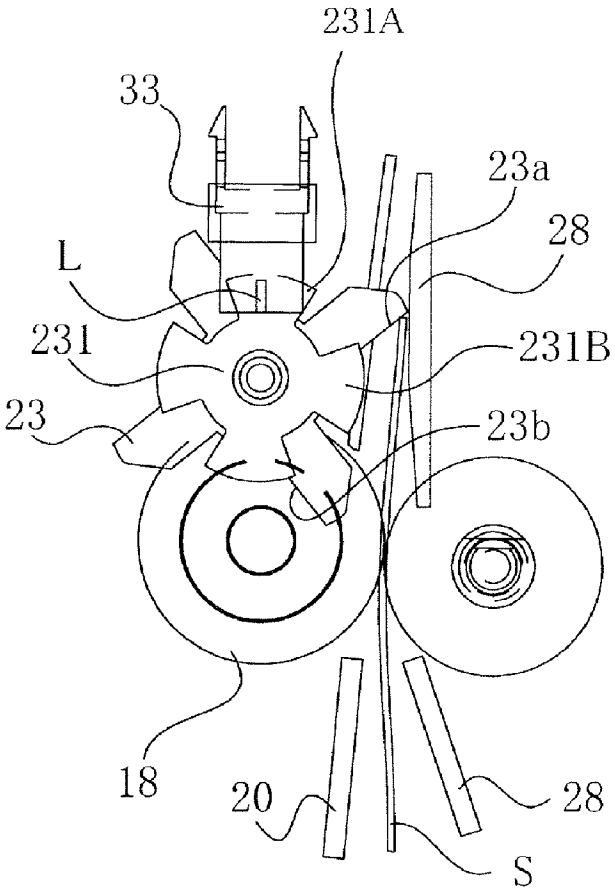
FIG. 15B is a view illustrating the sensor lever, the detection sensor, and the detecting member of FIG. 15A.
Figure 15A:
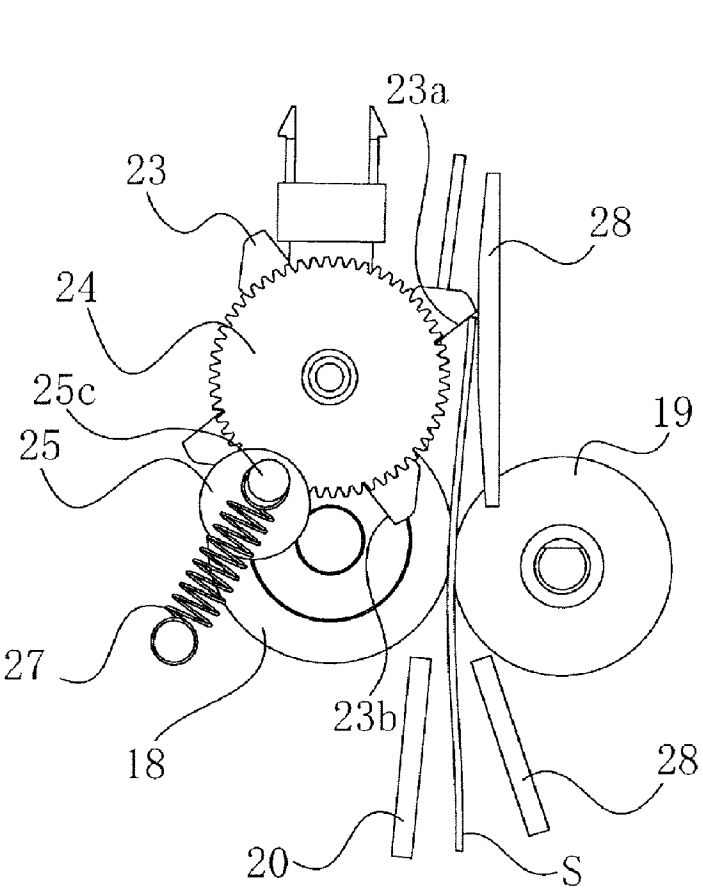
FIG. 15A is a view illustrating a state in which the sensor lever of the sheet detecting portion of FIG. 14A rotates to expand a shutter spring to its maximum length.
Figure 16B:
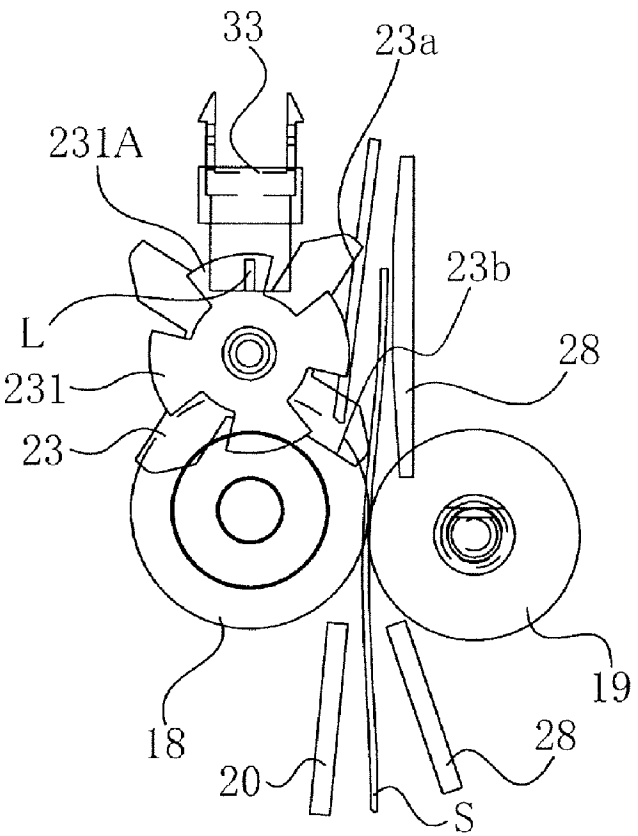
FIG. 16B is a view illustrating the sensor lever, the detection sensor, and the detecting member of FIG. 16A.
Figure 16A:
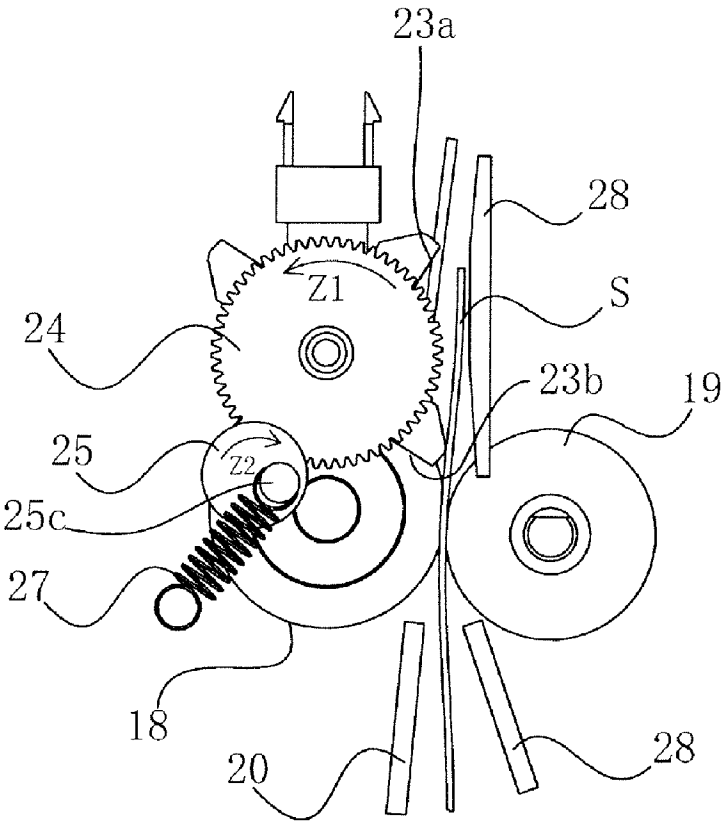
FIG. 16A is a view illustrating a state in which the sensor lever of the sheet detecting portion of FIG. 15A rotates to retreat the abutment surface.

Next, the operation of the sheet conveying portion 9A will be described with reference to FIGS. 13A to 16B. FIG. 13A is a view illustrating a state in which the sheet S is conveyed to the sheet detecting portion 200A according to the second embodiment. FIG. 13B is a view illustrating the sensor lever 23, the detection sensor 33, and the detecting member 231 of FIG. 13A. FIG. 14A is a view illustrating a state in which the leading edge of the sheet S abuts against the abutment surface 23*a* of the sensor lever 23 of the sheet detecting portion 200A illustrated in FIG. 13A to rotate the sensor lever 23. FIG. 14B is a view illustrating the sensor lever 23, the detection sensor 33, and the detecting member 231 of FIG. 14A. FIG. 15A is a view illustrating a state in which the sensor lever 23 of the sheet detecting portion 200A of FIG. 14A rotates to expand the sensor lever spring 27 to its maximum length. FIG. 15B is a view illustrating the sensor lever 23, the detection sensor 33, and the detecting member 231 of FIG. 15A. FIG. 16A is a view illustrating a state in which the sensor lever 23 of the sheet detecting portion 200A of FIG. 15A rotates to retreat the abutment surface 23*a*. FIG. 16B is a view illustrating the sensor lever 23, the detection sensor 33, and the detecting member 231 of FIG. 16A.

As illustrated in FIG. 13A, when the leading edge of the sheet S does not abut against the abutment surface 23*a* of the sensor lever 23, the abutment surface 23*a* is held in a state of waiting in a waiting position with an urging force (retention force) of the sensor lever spring 27. At this time, the sensor lever spring 27 is shortened to its minimum length, and the connecting portion 25*c* connected to the sensor lever spring 27 is positioned in a bottom dead center of the sensor lever spring 27. Further, the optical path L of the detection sensor 33 at this time is not shielded from light by the light-shielding portion 231A and is light-transmissive, as illustrated in FIG. 13B.

Next, as illustrated in FIG. 14A, when the leading edge of the sheet S conveyed by the conveying roller pairs 18, 19 abuts against the abutment surface 23*a* of the sensor lever 23, the sheet S presses the abutment surface 23*a* against the urging force of the sensor lever spring 27 with a conveying force of the conveying roller pairs 18, 19. When the sheet S presses the abutment surface 23*a*, the sensor lever 23 starts rotating in the Z1 direction illustrated in FIG. 14A. Thus, as illustrated in FIG. 14B, the light-shielding portion 231A which has allowed light to transmit through the optical path L of the detection sensor 33 also rotates to shield the optical path L from light. When the light-shielding portion 231A shields the optical path L from light, the detection sensor 33 detects that the leading edge of the sheet S has reached a desired position and issues a predetermined signal. Then, the image forming portion 14 starts an image formation operation based on the signal. Thus, the detection sensor detects the sheet S based on a rotation position (movement position) of the light-shielding portion 231A.

As illustrated in FIGS. 15A and 15B, when the leading edge of the sheet S presses the abutment surface 23*a* to rotate the sensor lever 23, and the sensor lever drive member 25 rotates at an increased speed at a speed ratio of the same number as that of the abutment surfaces, the connecting portion 25*c* is positioned in a top dead center of the sensor lever spring 27. That is, the sensor lever spring 27 expands to its maximum length (the maximum length state). Then, as illustrated in FIGS. 16A and 16B, when the sensor lever 23 further rotates in the Z1 direction, and the sensor lever drive member 25 rotates in the Z2 direction, the connecting portion 25*c* passes over the top dead center of the sensor lever spring 27. When the connecting portion 25*c* passes over the top dead center, the sensor lever 23 is provided with a rotation force for rotating the sensor lever 23 in the Z1 direction from the sensor lever spring 27 without the sheet S. The rotation force positions the succeeding abutment surface 23*b* in the waiting position and holds the succeeding abutment surface 23*b* in the waiting position in the same way as in the abutment surface 23*a*.

Herein, as illustrated in FIGS. 16A and 16B, when the rotation force for rotating the sensor lever 23 in the Z1 direction (rotation force for positioning in the waiting position) from the sensor lever spring 27 is exerted on the sensor lever 23, the sensor lever 23 rotates in the Z1 direction. However, the sheet S is being conveyed by the conveying roller pairs 18, 19. Therefore, the sensor lever cannot rotate any more, and the succeeding abutment surface 23*b* upstream of the abutment surface 23*a* cannot be positioned in the waiting position (cannot protrude to the sheet conveying path 15*a*). Thus, the succeeding abutment surface 23*b* remains waiting until the sheet S passes by, with the sensor lever 23 abutting against the surface of the sheet S.

When the trailing edge of the sheet S passes through the nip of the conveying roller pairs 18, 19, the sensor lever 23 rotates in the Z1 direction due to the rotation force of the sensor lever spring 27, and the succeeding abutment surface 23*b* protrudes to the sheet conveying path 15*a* to be positioned in the waiting position. At this time, the light-shielding portion 231A passes through the optical path L of the detection sensor 33, and hence, the detection sensor 33 is brought into a light-transmissive state and the position of a leading edge of the sheet S can be detected.

Through the repetition of the operation illustrated in FIGS. 13A to 16B, the sensor lever 23, the detecting member 231, and the sensor lever gear 24 on the sensor lever rotary shaft 23*e* rotate, and the sensor lever drive member 25 rotates at an increased speed at a speed ratio of the same number as that of the abutment surfaces. Thus, the sensor lever drive member 25 makes one turn in the middle of the rotation of the sensor lever 23 and the abutment surfaces 23*a* to 23*d* are switched successively in the order of 23*a*, 23*b*, 23*c*, 23*d*, and 23*a*.

The image forming apparatus 100A according to the second embodiment having the above-mentioned configuration exhibits the following effect, in addition to the effects obtained from the configuration similar to that of the first embodiment. In the sheet detecting portion 200A of the image forming apparatus 100A according to the second embodiment, the arrangement and shape of the abutment surfaces 23*a* to 23*d* of the sensor lever 23 and the light-shielding portions 231A to 231D of the detecting member 231 can have a degree of freedom. Thus, the leading edge of the sheet S can be detected with higher precision.

Third Embodiment

Next, an image forming apparatus 100B according to a third embodiment of the present invention will be described with reference to FIGS. 17A to 22B together with FIG. 1. The image forming apparatus 100B according to the third embodiment is different from the image forming apparatus 100 of the first embodiment in that a detecting member 250 which operates in association with the sensor lever 23 is provided in a sheet detecting portion 200B of a sheet conveying portion 9B. Therefore, in the third embodiment, the point different from the first embodiment, that is, the detecting member 250 will be mainly described. Note that, in the third embodiment, the same components as those of the image forming apparatus 100 according to the first embodiment are denoted by the same reference symbols, and the descriptions thereof are omitted. In the third embodiment, the same components as those of the first embodiment produce the same effects as those of the first embodiment.

Figure 17A:
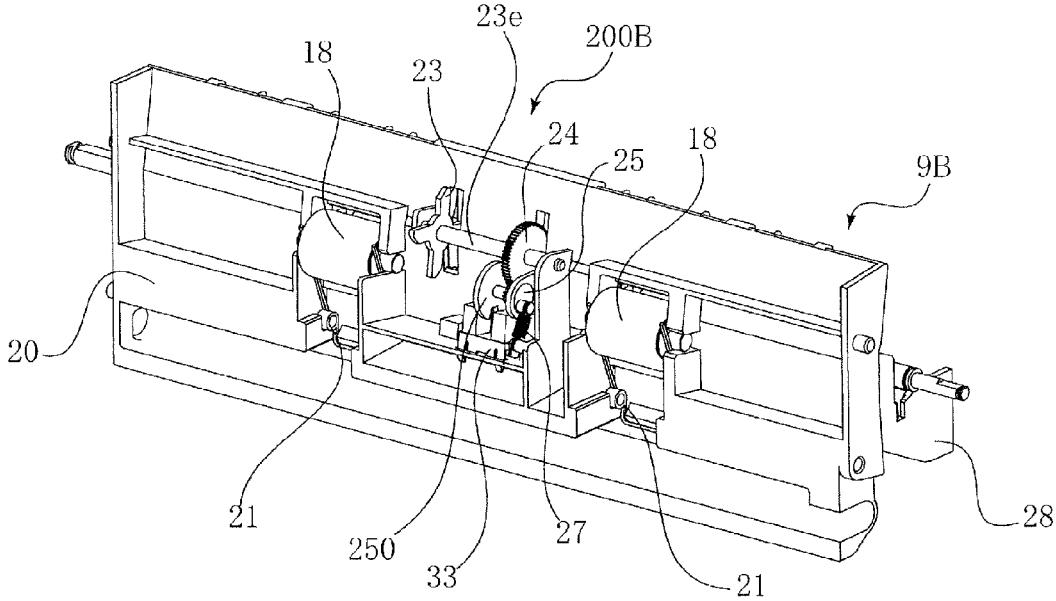
FIG. 17A is a perspective view of a sheet conveying portion of an image forming apparatus according to a third embodiment of the present invention.
Figure 17B:
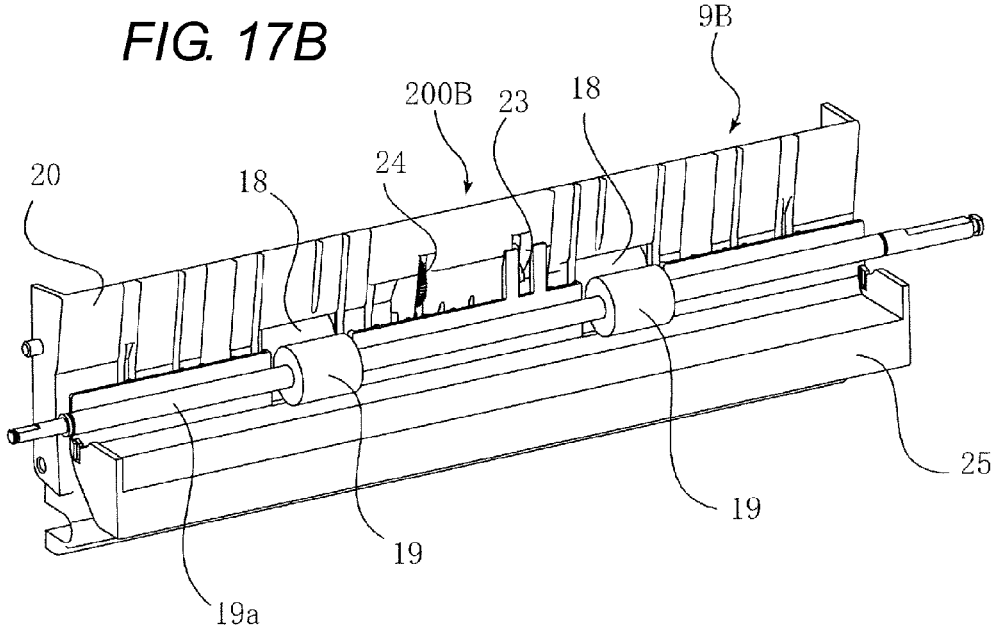
FIG. 17B is a perspective view of the sheet conveying portion of FIG. 17A, when viewed from an opposite side of FIG. 17A.
Figure 18:
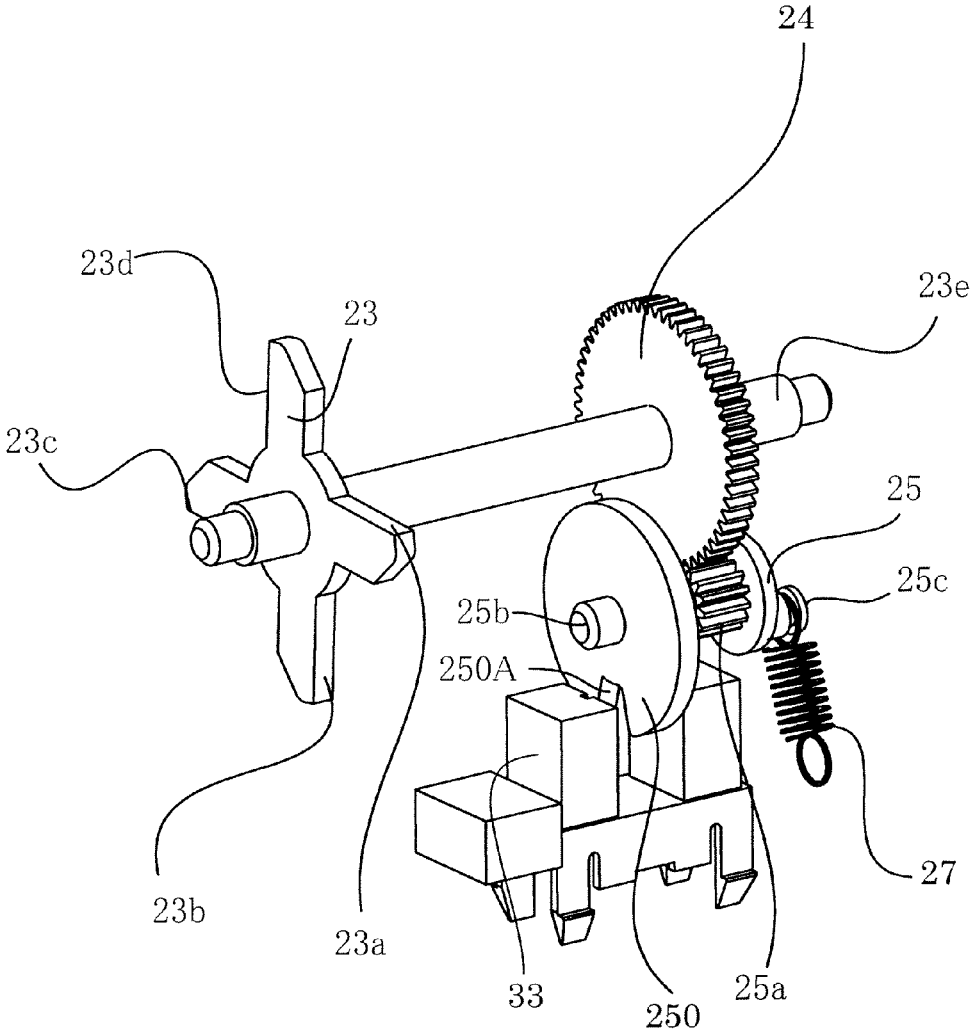
FIG. 18 is a perspective view illustrating a sheet detecting portion according to the third embodiment of the present invention.

First, an entire structure of the image forming apparatus 100B according to the third embodiment will be described with reference to FIGS. 17A to 18 together with FIG. 1. FIG. 17A is a perspective view of the sheet conveying portion 9B of the image forming apparatus 100B according to the third embodiment. FIG. 17B is a perspective view of the sheet conveying portion 9B illustrated in FIG. 17A, when viewed from an opposite side of FIG. 17A. FIG. 18 is a perspective view illustrating the sheet detecting portion 200B according to the third embodiment.

As illustrated in FIG. 1, the image forming apparatus 100B includes the sheet feeding portion 8, the sheet conveying portion 9B, the image forming portion 14, the fixing portion 10, and the sheet delivery portion 13. As illustrated in FIGS. 17A and 17B, the sheet conveying portion 9B includes the feed frame 20 and the guide frame 28, the conveying roller pairs 18, 19, and the sheet detecting portion 200B. As illustrated in FIG. 18, the sheet detecting portion 200B includes the sensor lever 23, the sensor lever gear 24, the sensor lever drive member 25, the sensor lever spring 27, the detection sensor 33, and the detecting member 250.

The detecting member 250 is fixed to the rotary shaft 25*b* of the sensor lever drive member 25 and rotates integrally with the sensor lever drive member 25. Further, the detecting member 250 is formed into a disk shape and is formed so as to shield the optical path L of the detection sensor 33 from light. Further, the detecting member 250 includes a cut-away portion 250A that is cut away partially, and the cut-away portion 250A allows light to transmit through the optical path L of the detection sensor 33.

Figure 19B:
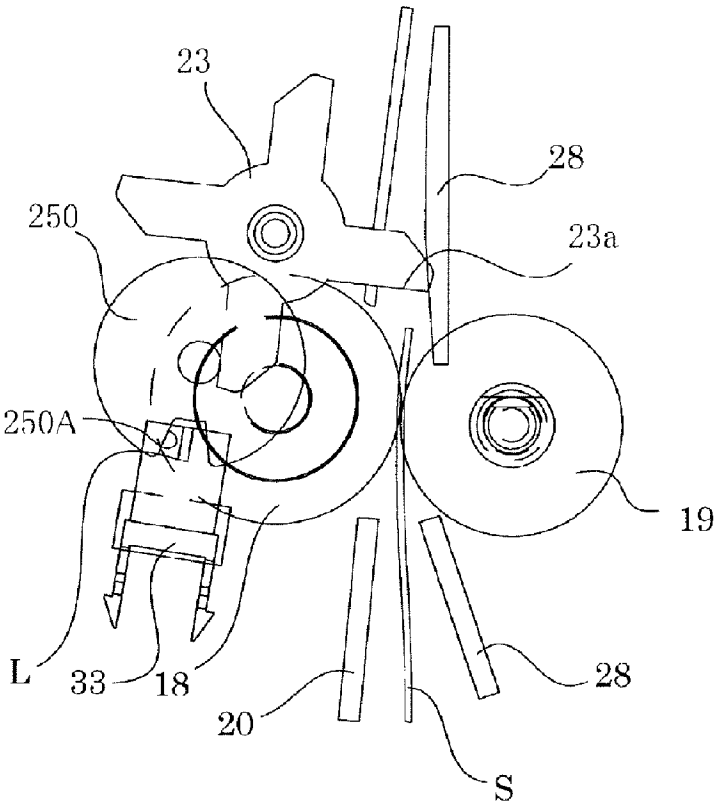
FIG. 19B is a view illustrating a sensor lever, a detection sensor, and a detecting member of FIG. 19A.
Figure 19A:
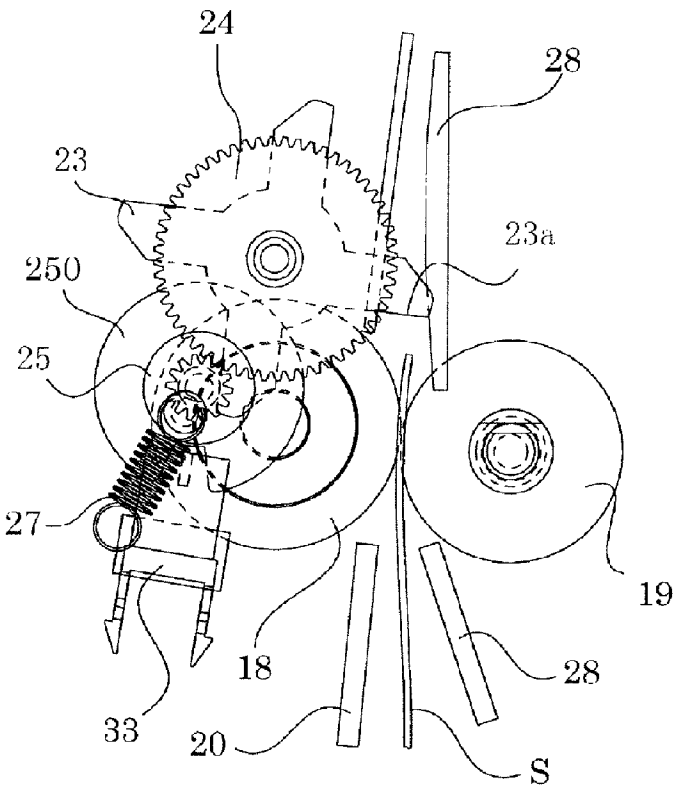
FIG. 19A is a view illustrating a state in which a sheet is conveyed to the sheet detecting portion according to the third embodiment of the present invention.
Figure 20B:
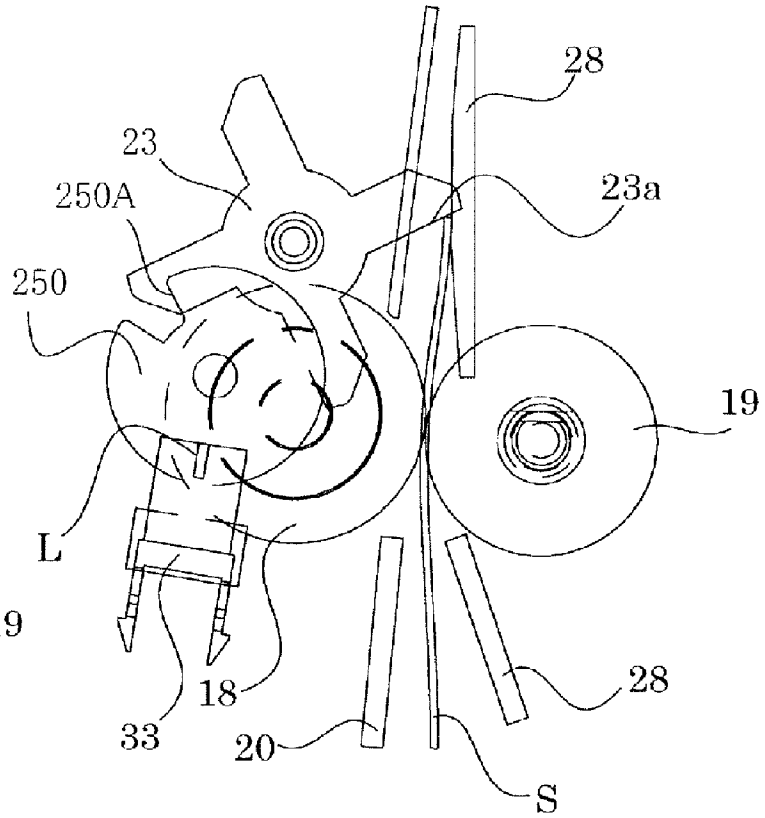
FIG. 20B is a view illustrating the sensor lever, the detection sensor, and the detecting member of FIG. 20A.
Figure 20A:
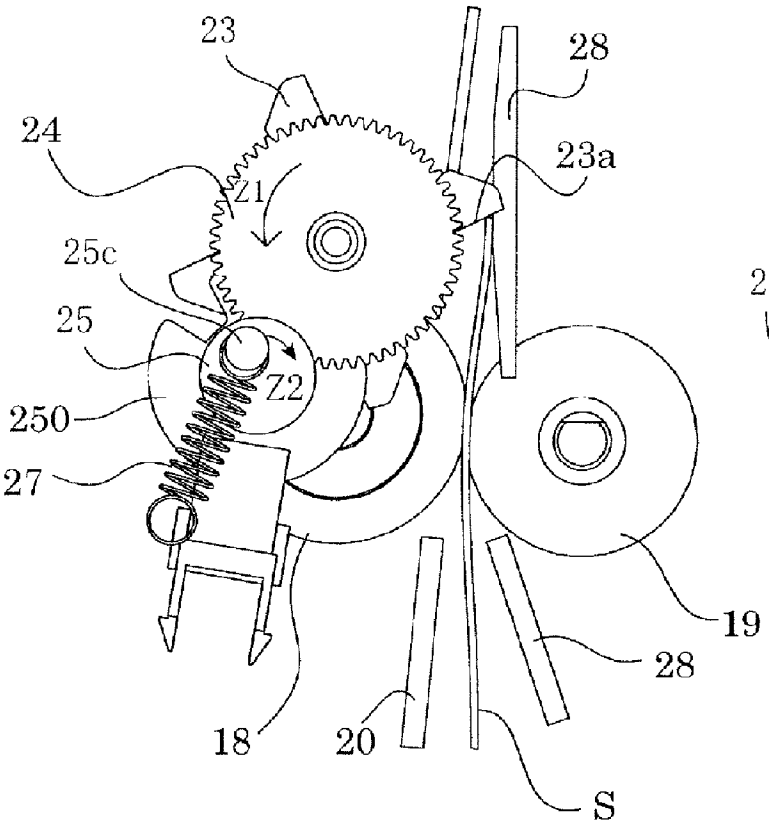
FIG. 20A is a view illustrating a state in which the leading edge of a sheet abuts against an abutment surface of the sensor lever of the sheet detecting portion illustrated in FIG. 19A to rotate the sensor lever.
Figure 21B:
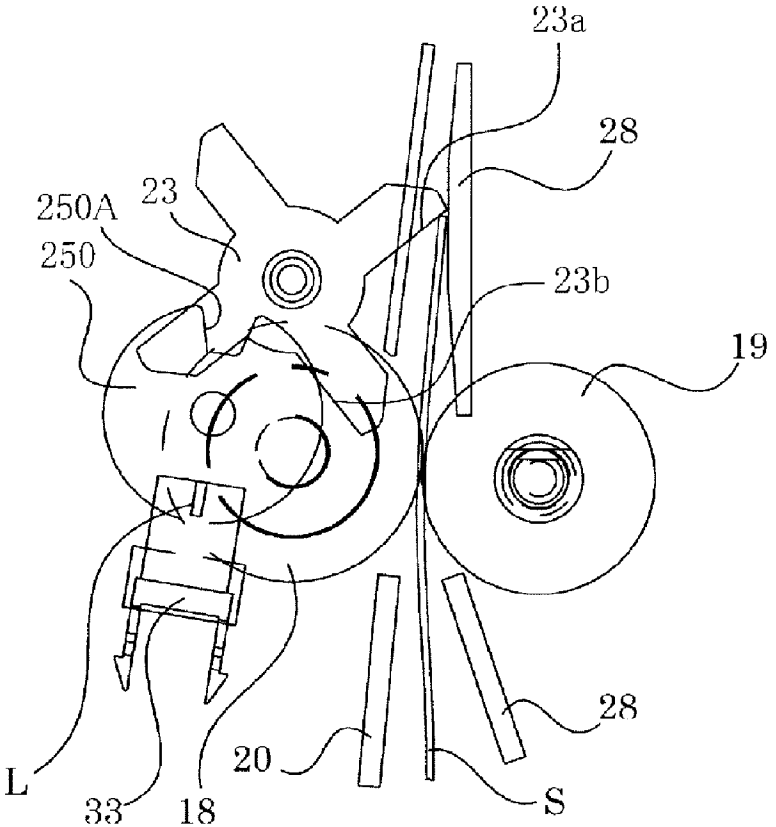
FIG. 21B is a view illustrating the sensor lever, the detection sensor, and the detecting member of FIG. 21A.
Figure 21A:
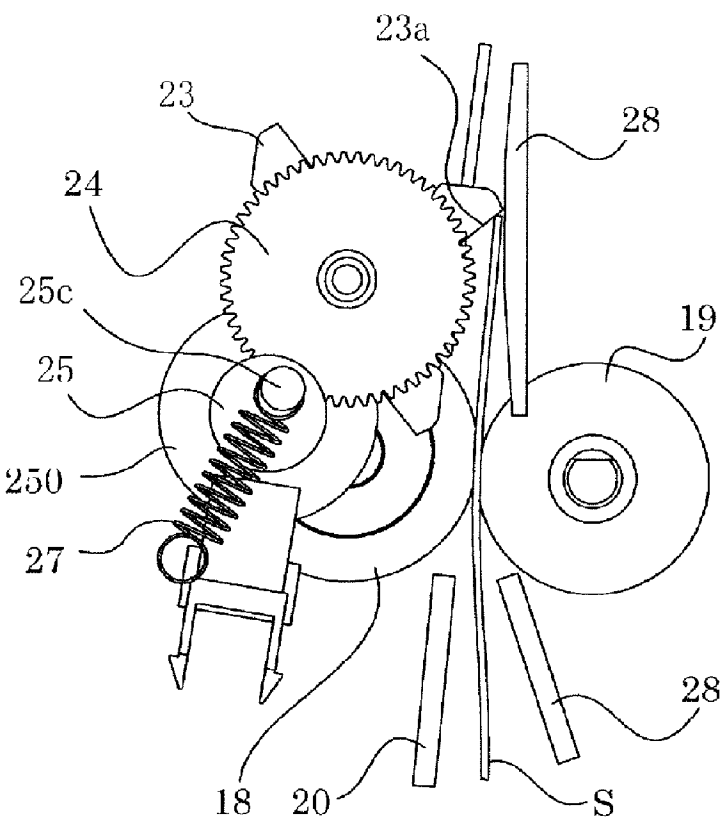
FIG. 21A is a view illustrating a state in which the sensor lever of the sheet detecting portion illustrated in FIG. 20A rotates to expand a shutter spring to its maximum length.
Figure 22B:
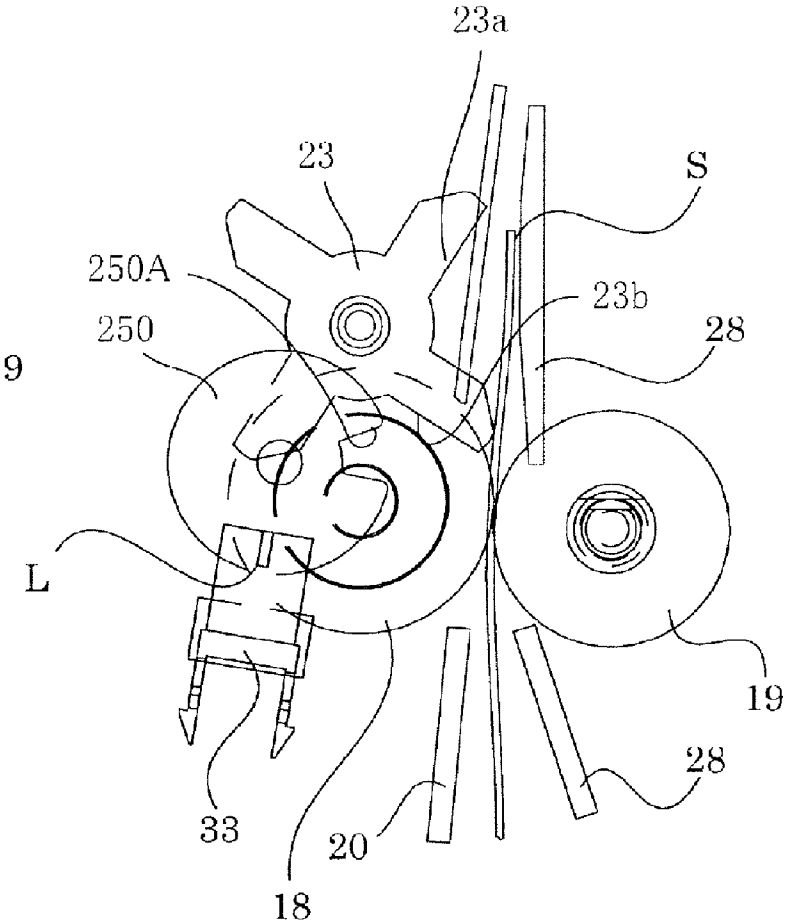
FIG. 22B is a view illustrating the sensor lever, the detection sensor, and the detecting member of FIG. 22A.
Figure 22A:
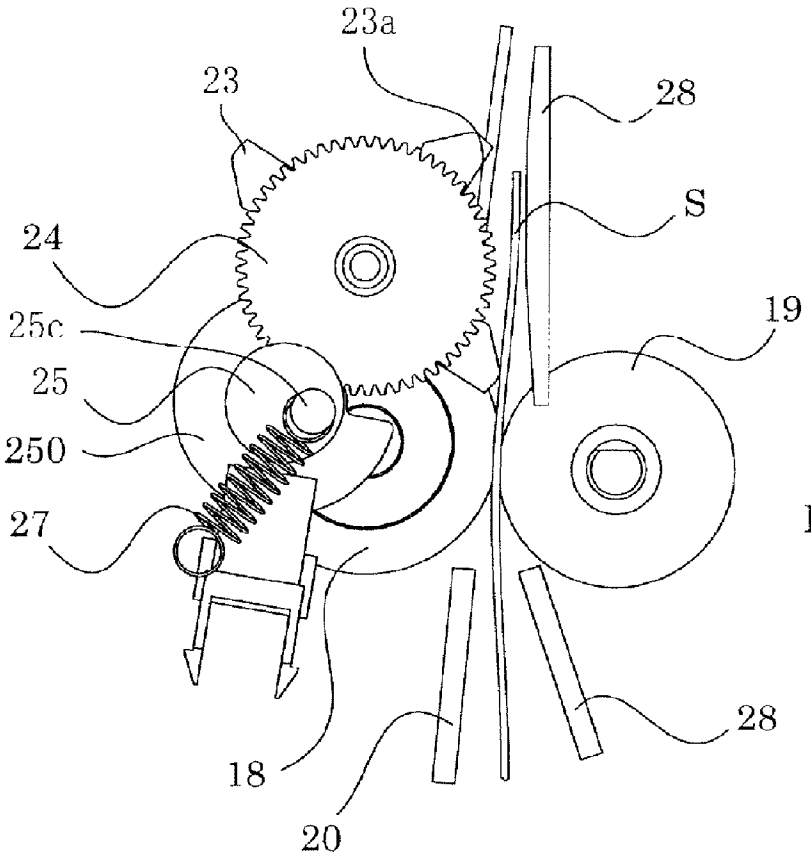
FIG. 22A is a view illustrating a state in which the sensor lever of the sheet detecting portion of FIG. 21A rotates to retreat an abutment surface.
Figure 23:
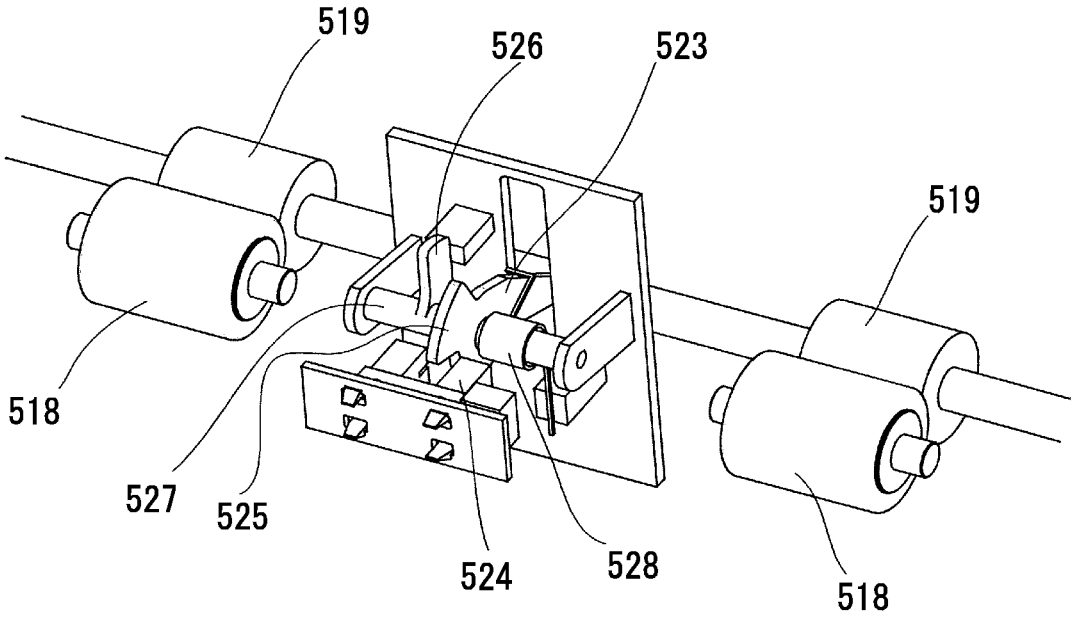
FIG. 23 is a perspective view illustrating a sheet detecting portion of an image forming apparatus according to a conventional example.
Figure 24A:
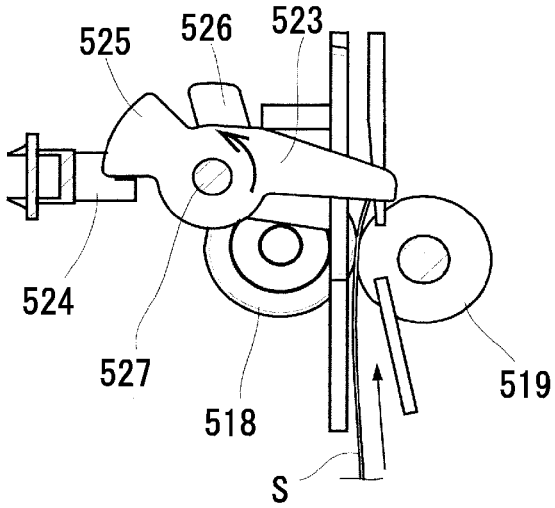
FIG. 24A is a view illustrating a state in which the leading edge of a sheet abuts against a sensor lever of the sheet detecting portion according to the conventional example.
Figure 24B:
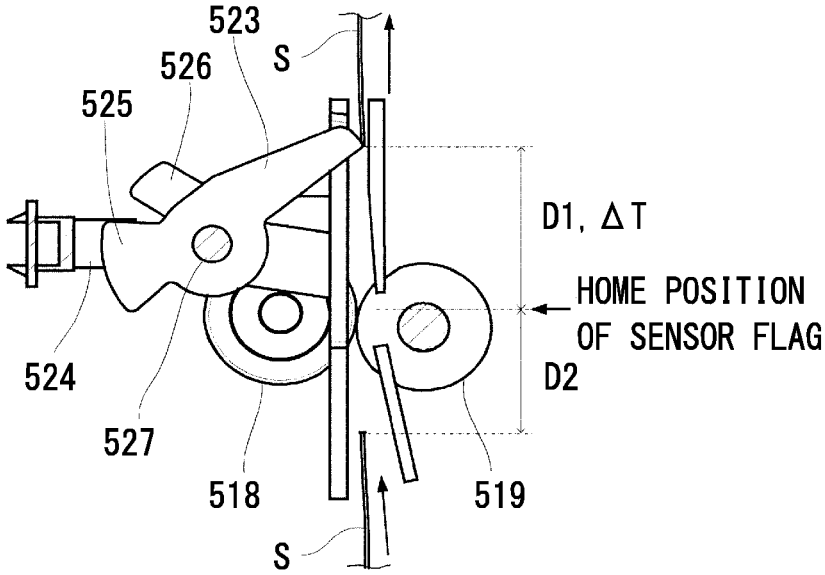
Figure 24C:
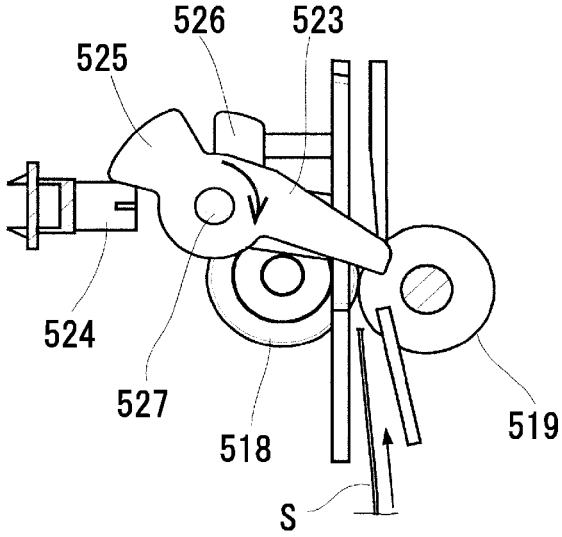
FIG. 24C is a view illustrating a state in which the sheet has passed by and the sensor lever has returned to a waiting position.

Next, the operation of the sheet conveying portion 9B will be described with reference to FIGS. 19A to 22B. FIG. 19A is a view illustrating a state in which the sheet S is conveyed to the sheet detecting portion 200B according to the third embodiment. FIG. 19B is a view illustrating the sensor lever 23, the detection sensor 33, and the detecting member 250 of FIG. 19A. FIG. 20A is a view illustrating a state in which the sensor lever 23 of the sheet detecting portion 200B illustrated in FIG. 19A to rotates. FIG. 20B is a view illustrating the sensor lever 23, the detection sensor 33, and the detecting member 250 of FIG. 20A. FIG. 21A is a view illustrating a state in which the sensor lever 23 of the sheet detecting portion 200B of FIG. 20A rotates to expand the sensor lever spring 27 to its maximum length. FIG. 21B is a view illustrating the sensor lever 23, the detection sensor 33, and the detecting member 250 of FIG. 21A. FIG. 22A is a view illustrating a state in which the sensor lever 23 of the sheet detecting portion 200B of FIG. 21A rotates to retreat the abutment surface 23*a*. FIG. 22B is a view illustrating the sensor lever 23, the detection sensor 33, and the detecting member 250 of FIG. 22A.

As illustrated in FIG. 19A, when the leading edge of the sheet S does not abut against the abutment surface 23*a* of the sensor lever 23, the abutment surface 23*a* is held in a state of waiting in a waiting position with an urging force (retention force) of the sensor lever spring 27. At this time, the sensor lever spring 27 is shortened to its minimum length, and the connecting portion 25*c* connected to the sensor lever spring 27 is positioned in a bottom dead center in the sensor lever spring 27. Further, the optical path L of the detection sensor 33 at this time is not shielded from light by the detecting member 250 and is light-transmissive, as illustrated in FIG. 19B.

Next, as illustrated in FIG. 20A, when the leading edge of the sheet S conveyed by the conveying roller pairs 18, 19 abuts against the abutment surface 23*a* of the sensor lever 23, the sheet S presses the abutment surface 23*a* against the urging force of the sensor lever spring 27 with a conveying force of the conveying roller pairs 18, 19. When the sheet S presses the abutment surface 23*a*, the sensor lever 23 starts rotating in the Z1 direction illustrated in FIG. 20A. Thus, as illustrated in FIG. 20B, the sensor lever drive member 25 and the detecting member 250 rotate at an increased speed in the Z2 direction and the detecting member 250 which has allowed light to transmit through the optical path L of the detection sensor 33 shields the optical path L from light. When the detecting member 250 shields the optical path L from light, the detection sensor 33 detects that the leading edge of the sheet S has reached a desired position and issues a predetermined signal. Then, the image forming portion 14 starts an image formation operation based on the signal.

As illustrated in FIGS. 21A and 21B, the leading edge of the sheet S presses the abutment surface 23*a* to rotate the sensor lever 23, and the sensor lever drive member 25 and the detecting member 250 rotate at an increased speed at a speed ratio of the same number as that of the abutment surfaces. Then, the connecting portion 25*c* is positioned in a top dead center of the sensor lever spring 27. That is, the sensor lever spring 27 expands to its maximum length (the maximum length state). Then, as illustrated in FIGS. 22A and 22B, when the sensor lever 23 further rotates in the Z1 direction, and the sensor lever drive member 25 rotates in the Z2 direction, the connecting portion 25*c* passes over the top dead center of the sensor lever spring 27. When the connecting portion 25*c* passes over the top dead center, a rotation force for rotating the sensor lever 23 in the Z1 direction from the sensor lever spring 27 without the sheet S is exerted on the sensor lever 23. The rotation force positions the succeeding abutment surface 23*b* in the waiting position and holds the succeeding abutment surface 23*b* in the waiting position in the same way as in the abutment surface 23*a*.

Herein, as illustrated in FIGS. 22A and 22B, when the rotation force for rotating the sensor lever 23 in the Z1 direction (rotation force for positioning in the waiting position) from the sensor lever spring 27 is exerted on the sensor lever 23, the sensor lever 23 rotates in the Z1 direction. However, the sheet S is being conveyed by the conveying roller pairs 18, 19. Therefore, the sensor lever cannot rotate any more, and the succeeding abutment surface 23*b* upstream of the abutment surface 23*a* cannot be positioned in the waiting position (cannot protrude to the sheet conveying path 15*a*). Thus, the succeeding abutment surface 23*b* remains waiting until the sheet S passes by, with the sensor lever 23 abutting against the surface of the sheet S.

When the trailing edge of the sheet S passes through the nip of the conveying roller pairs 18, 19, the sensor lever 23 rotates in the Z1 direction due to the rotation force of the sensor lever spring 27, and the succeeding abutment surface 23*b* protrudes to the sheet conveying path 15*a* to be positioned in the waiting position. At this time, the cut-away portion 250A of the detecting member 250 is positioned in the optical path L of the detection sensor 33, and hence, the detection sensor 33 is brought into a light-transmissive state and the position of a leading edge of the sheet S can be detected.

Through the repetition of the operation illustrated in FIGS. 19A to 22B, the sensor lever 23, the detecting member 250, and the sensor lever gear 24 rotate, and the sensor lever drive member 25 and the detecting member 250 rotate at an increased speed at a speed ratio of the same number as that of the abutment surfaces. Thus, the sensor lever drive member 25 makes one turn in the middle of the rotation of the sensor lever 23 and the abutment surfaces 23*a* to 23*d* are switched successively in the order of 23*a*, 23*b*, 23*c*, 23*d*, and 23*a*.

The image forming apparatus 100B according to the third embodiment having the above-mentioned configuration exhibits the following effect, in addition to the effects obtained from the configuration similar to that of the first embodiment. In the sheet detecting portion 200B of the image forming apparatus 100B according to the third embodiment, the arrangement and shape of the abutment surfaces 23*a* to 23*d* of the sensor lever 23 and the detecting member 250 can have a degree of freedom. Thus, the leading edge of the sheet S can be detected with higher precision.

Although the embodiments of the present invention are described above, the present invention is not limited to the above-mentioned embodiments. Further, the effects described in the embodiments of the present invention are the most preferred effects obtained from the present invention, and the effects of the present invention are not limited to those described in the embodiments of the present invention.

Further, in this embodiment, the sensor lever gear (first rotary member) 24 and the sensor lever drive member (second rotary member) 25 are connected through use of gears, but the present invention is not limited thereto. For example, the sensor lever gear (first rotary member) 24 and the sensor lever drive member (second rotary member) 25 may be connected through use of a timing belt or the like to increase the rotation (one turn with respect to ¼ turn) of the sensor lever drive member (second rotary member) 25.

Further, for example, in the embodiments of the present invention, four abutment surfaces are provided, but the present invention is not limited thereto. The number of the abutment surfaces may be set as follows, for example: the gear ratio of the second rotary member to the first rotary member is set with an integer ratio of the same number as the number of the abutment surfaces, and the second rotary member is rotated by switching the abutment surfaces.

For example, in the first embodiment, when the sheet detecting portion 200 detects that the leading edge of the sheet S has been conveyed to a desired position, the image forming portion 14 starts forming a toner image (image formation processing). However, the present invention is not limited thereto. The image forming apparatus 100 may have a configuration in which the image forming portion 14 forms a toner image (image formation processing) in advance, and when the sheet detecting portion 200 detects the sheet S, an image is conveyed to the transfer rollers 5*a* to 5*d* at a timing when the sheet S reaches the transfer rollers 5*a* to 5*d*.

Further, for example, in this embodiment, the rotary lever is allowed to wait at a first position through use of the sensor lever spring 27, but the present invention is not limited thereto. For example, the abutment surface of the rotary lever may be allowed to wait at the first position with the aid of gravitational force of the rotary lever by adjusting the weight balance of the rotary lever. Further, the elastic force of a plate spring or rubber may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-058349, filed Mar. 16, 2011, which is hereby incorporated by reference herein in its entirety.

What is claimed is:

1. A sheet detecting apparatus which detects a sheet conveyed by a conveying portion which conveys the sheet, the sheet detecting apparatus comprising:

a sheet detecting member including a plurality of abutment surfaces against which a leading edge of the sheet conveyed by the conveying portion abuts, the plurality of abutment surfaces being formed in a peripheral direction of the sheet detecting member, the plurality of abutment surfaces of the sheet detecting member being pressed by the conveyed sheet to rotate from a waiting position;

a sensor which generates a signal based on a position of the plurality of abutment surfaces;

a shaft connected to the sheet detecting member to support the sheet detecting member in a rotatable manner;

a first rotary member connected to the shaft and configured to rotate around a first rotation center;

a second rotary member connected to the first rotary member and configured to rotate around a second rotation center, wherein if N is a number of the plurality of abutment surfaces, one revolution of the second rotary member around the second rotation center makes 1/N revolution of the first rotary member around the first rotation center; and a biasing portion configured to bias the second rotary member to be positioned at a predetermined position in a rotation direction of the second rotary member around the second rotation center so as to position one of the plurality of abutment surfaces at the waiting position.

2. A sheet detecting apparatus according to claim 1, wherein the biasing portion comprises an urging spring, wherein one end of the urging spring is positionally-fixed and another end of the urging spring is connected to a connecting portion arranged eccentrically from the second rotation center of the second rotary member.

3. A sheet detecting apparatus which detects a sheet conveyed by a conveying portion which conveys the sheet, the sheet detecting apparatus comprising:

a sheet detecting member including a plurality of abutment surfaces against which a leading edge of the sheet conveyed by the conveying portion abuts, the plurality of abutment surfaces being formed in a peripheral direction of the sheet detecting member, the sheet detecting member being pressed by the conveyed sheet to rotate;

a sensor which generates a signal based on a position of the plurality of abutment surfaces; and a positioning portion which positions one of the plurality of abutment surfaces of the sheet detecting member in a waiting position in which the leading edge of the sheet conveyed by the conveying portion abuts against the one of the plurality of abutment surfaces, wherein the positioning portion comprises:

a first gear connected to a rotary shaft of the sheet detecting member;

a second gear meshed with the first gear, wherein if N is a number of the plurality of abutment surfaces, one revolution of the second gear makes 1/N revolution of the first gear; and an urging spring having one end positionally-fixed and another end connected to a connecting portion arranged offset with respect to a rotation center of the second gear.

4. An image forming apparatus, comprising:

a sheet detecting apparatus as recited in claim 1; and an image forming portion which forms an image on a sheet sent from the sheet detecting apparatus.

5. An image forming apparatus according to claim 4, wherein the image forming portion starts an image formation operation for forming an image on a sheet conveyed based on a signal from a sensor.

6. An image forming apparatus according to claim 4, wherein the biasing portion comprises an urging spring, wherein one end of the urging spring is positionally-fixed and another end of the urging spring is connected to a connecting portion arranged eccentrically from the second rotation center of the second rotary member.

7. An image forming apparatus, comprising:

a sheet detecting apparatus as recited in claim 3; and an image forming portion which forms an image on a sheet sent from the sheet detecting apparatus.

8. An image forming apparatus according to claim 7, wherein the image forming portion starts an image formation operation for forming an image on a sheet conveyed based on a signal from a sensor.

9. A sheet detecting apparatus according to claim 1, wherein the biasing portion connected to a part of the second rotary member located offset with respect to the second rotation center of the second rotary member to hold the second rotary member at the predetermined position in the rotation direction and to position one abutment surface of the plurality of abutment surfaces in the waiting position where the leading edge of the conveyed sheet abuts the abutment surface.

10. A sheet detecting apparatus according to claim 1, wherein the biasing portion comprises an urging spring which provides the sheet detecting member with an urging force for positioning the one of the plurality of abutment surfaces in the waiting position, the urging spring being connected to the second rotary member in such a manner that, when a rotation of the first rotary member along with a rotation of the sheet detecting member is transmitted to the second rotary member to rotate the second rotary member by a predetermined angle, a state in which the urging spring exerts an urging force for positioning the one of the plurality of abutment surfaces to the waiting position is changed to a state in which the urging spring exerts an urging force for positioning, in the waiting position, another one of the plurality of abutment surfaces against which a succeeding sheet abuts.

11. A sheet detecting apparatus according to claim 1, wherein the first rotary member is a first gear, and the second rotary member is a second gear meshed with the first gear.

* * * * *